US005969701A

United States Patent [19]

Numao et al.

[11] Patent Number: 5,969,701

[45] Date of Patent: Oct. 19, 1999

[54] DRIVING DEVICE AND DRIVING METHOD OF MATRIX-TYPE DISPLAY APPARATUS FOR CARRYING OUT TIME-DIVISION GRADATION DISPLAY

[75] Inventors: Takaji Numao; Kazunari Tomizawa, both of Kashiwa, Japan

[73] Assignees: Sharp Kabushiki Kaisha, Osaka, Japan; The Secretary of State for Defence in Her Britannic Majesty's Government of the United Kingdom of Great Britain and Northern Ireland, Hants, United Kingdom

[21] Appl. No.: 08/744,172

[22] Filed: Nov. 5, 1996

[30] Foreign Application Priority Data

Nov. 6, 1995 [JP] Japan ..... 7-287676

[51] Int. Cl.[6] ..... G09G 3/36

[52] U.S. Cl. ..... 345/89; 345/97

[58] Field of Search ..... 345/87, 88, 89, 345/92, 94, 95, 96, 98, 97, 103; 349/33, 34, 41, 42, 37

[56] References Cited

U.S. PATENT DOCUMENTS

| | | | |
|---|---|---|---|
| 4,929,058 | 5/1990 | Numao | 350/333 |
| 5,552,800 | 9/1996 | Uchikoga et al. | 345/89 |
| 5,602,559 | 2/1997 | Kimura | 345/89 |
| 5,831,586 | 11/1998 | Hirai et al. | 345/96 |

FOREIGN PATENT DOCUMENTS

| | | |
|---|---|---|
| 0488891 | 6/1992 | European Pat. Off. . |
| 0605865 | 7/1994 | European Pat. Off. . |
| 0658870 | 6/1995 | European Pat. Off. . |
| 62-056936 | 3/1987 | Japan . |
| 63-226178 | 9/1988 | Japan . |
| 5107521 | 4/1993 | Japan . |
| 6043829 | 2/1994 | Japan . |

OTHER PUBLICATIONS

"The "Joers/Alvey" Ferroelectric Multiplexing Scheme" (P.W.H. Surguy et al., Ferroelectronics, 1991, vol. 122, pp. 63–79.

"Color Digital Ferroelectric LCDS for laptop Applications" (P.W. Ross et al., SID 92 Digest, pp. 217–220), 1992.

"A new set of high speed matrix addressing schemes for ferroelectric liquid crystal displays" (J.R. Hughes et al, Liquid Crystals, 1993, vol. 13, No. 4 pp. 597–601).

*Primary Examiner*—Chanh Nguyen

[57] ABSTRACT

A matrix-type display apparatus which permits a gradation display of gradation number R (R is an integer of not less than 2) includes m scanning electrodes and scans the m scanning electrodes n times in one frame period. The matrix-type display apparatus performs a time-division gradation display under such condition that a time ratio of display periods of the 1st, the 2nd, . . . , the nth display periods is exactly X:RX: . . . $R^{n-1}X$ ($X \geqq 0$). To enable such display, the matrix-type display apparatus is driven based on the below-defined R and n, and X determined based on R and n. R and n satisfy $ROT_n(X) \neq ROT_n((1+R)X)$, . . . $ROT_n(X) \neq ROT_n((1+R+. . .+R^{n-2})X$, $ROT_n((1+R+. . . +R^{n-2})X) \neq ROT_n((1+R+. . .+R^{n-1})X)=0$, wherein $ROT_n(a)$ is a remainder when dividing a (a is 0 or a positive integer) by n is (for example, R=4, n=3). X satisfies $(1+R+. . .+R^{n-1})X=n(m+b)$ ($b \geqq 0$) (for example, X=1). The data corresponding to the 1st, 2nd, . . . , the nth display periods are displayed respectively in the ath, the (X+a)th, . . . , and the $[(1+R+. . .+R^{n-2})X+a]$ selection periods.

26 Claims, 23 Drawing Sheets

FIG. 18

RAM53

| | | | | | | | | | | | | | | | | |
|---|---|---|---|---|---|---|---|---|---|---|---|---|---|---|---|---|
| INPUT ADDRESS | 0000 | 1000 | 2000 | 3000 | 0001 | 1001 | 2001 | 3001 | 0010 | 1010 | 2010 | 3010 | 0011 | 1011 | 2011 | 3011 |
| INPUT DATA | 000A | 001B | 002C | 003D | 004A | 005B | 006C | 007D | 010A | 011B | 012C | 013D | 014A | 015B | 016C | 017D |
| | $L_1$ DATA | | | | | | | | $L_2$ DATA | | | | | | | |

RAM54

| | | | | | | | | | | | | | | | | |
|---|---|---|---|---|---|---|---|---|---|---|---|---|---|---|---|---|
| INPUT ADDRESS | 1000 | 2000 | 3000 | 0000 | 1001 | 2001 | 3001 | 0001 | 1010 | 2010 | 3010 | 0010 | 1011 | 2011 | 3011 | 0011 |
| INPUT DATA | 000B | 001C | 002D | 003A | 004B | 005C | 006D | 007A | 010B | 011C | 012D | 013A | 014B | 015C | 016D | 017A |
| | $L_1$ DATA | | | | | | | | $L_2$ DATA | | | | | | | |

RAM55

| | | | | | | | | | | | | | | | | |
|---|---|---|---|---|---|---|---|---|---|---|---|---|---|---|---|---|
| INPUT ADDRESS | 2000 | 3000 | 0000 | 1000 | 2001 | 3001 | 0001 | 1001 | 2010 | 3010 | 0010 | 1010 | 2011 | 3011 | 0011 | 1011 |
| INPUT DATA | 000C | 001D | 002A | 003B | 004C | 005D | 006A | 007B | 010C | 011D | 012A | 013B | 014C | 015D | 016A | 017B |
| | $L_1$ DATA | | | | | | | | $L_2$ DATA | | | | | | | |

RAM56

| | | | | | | | | | | | | | | | | |
|---|---|---|---|---|---|---|---|---|---|---|---|---|---|---|---|---|
| INPUT ADDRESS | 3000 | 0000 | 1000 | 2000 | 3001 | 0001 | 1001 | 2001 | 3010 | 0010 | 1010 | 2010 | 3011 | 0011 | 1011 | 2011 |
| INPUT DATA | 000D | 001A | 002B | 003C | 004D | 005A | 006B | 007C | 010D | 011A | 012B | 013C | 014D | 015A | 016B | 017C |
| | $L_1$ DATA | | | | | | | | $L_2$ DATA | | | | | | | |

FIG. 19

RAM53

| | | | | | | | | | | | | | | | | |
|---|---|---|---|---|---|---|---|---|---|---|---|---|---|---|---|---|
| OUTPUT ADDRESS | 30E0 | 30E1 | 0000 | 0001 | 1020 | 1021 | 2060 | 2061 | 3000 | 3001 | 0010 | 0011 | 1030 | 1031 | 2070 | 2071 |
| OUTPUT DATA | 0E3D | 0E7D | 000A | 004A | 021B | 025B | 062C | 066C | 003D | 007D | 010A | 014A | 031B | 035B | 072C | 076C |
| | $L_{15}$/FOURTH 4bit | | $L_1$/FIRST 1bit | | $L_3$/SECOND 2bit | | $L_7$/THIRD 3bit | | $L_1$/FOURTH 4bit | | $L_2$/FIRST 1bit | | $L_4$/SECOND 2bit | | $L_8$/THIRD 3bit | |

RAM54

| | | | | | | | | | | | | | | | | |
|---|---|---|---|---|---|---|---|---|---|---|---|---|---|---|---|---|
| OUTPUT ADDRESS | 30E0 | 30E1 | 0000 | 0001 | 1020 | 1021 | 2060 | 2061 | 3000 | 3001 | 0010 | 0011 | 1030 | 1031 | 2070 | 2071 |
| OUTPUT DATA | 0E2D | 0E6D | 003A | 007A | 020B | 024B | 061C | 065C | 002D | 006D | 013A | 017A | 030B | 034B | 071C | 075C |
| | $L_{15}$/FOURTH 4bit | | $L_1$/FIRST 1bit | | $L_3$/SECOND 2bit | | $L_7$/THIRD 3bit | | $L_1$/FOURTH 4bit | | $L_2$/FIRST 1bit | | $L_4$/SECOND 2bit | | $L_8$/THIRD 3bit | |

RAM55

| | | | | | | | | | | | | | | | | |
|---|---|---|---|---|---|---|---|---|---|---|---|---|---|---|---|---|
| OUTPUT ADDRESS | 30E0 | 30E1 | 0000 | 0001 | 1020 | 1021 | 2060 | 2061 | 3000 | 3001 | 0010 | 0011 | 1030 | 1031 | 2070 | 2071 |
| OUTPUT DATA | 0E1D | 0E5D | 002A | 006A | 023B | 027B | 060C | 064C | 001D | 005D | 012A | 016A | 033B | 037B | 070C | 074C |
| | $L_{15}$/FOURTH 4bit | | $L_1$/FIRST 1bit | | $L_3$/SECOND 2bit | | $L_7$/THIRD 3bit | | $L_1$/FOURTH 4bit | | $L_2$/FIRST 1bit | | $L_4$/SECOND 2bit | | $L_8$/THIRD 3bit | |

RAM56

| | | | | | | | | | | | | | | | | |
|---|---|---|---|---|---|---|---|---|---|---|---|---|---|---|---|---|
| OUTPUT ADDRESS | 30E0 | 30E1 | 0000 | 0001 | 1020 | 1021 | 2060 | 2061 | 3000 | 3001 | 0010 | 0011 | 1030 | 1031 | 2070 | 2071 |
| OUTPUT DATA | 0E0D | 0E4D | 001A | 005A | 022B | 026B | 063C | 067C | 000D | 004D | 011A | 015A | 032B | 036B | 073C | 077C |
| | $L_{15}$/FOURTH 4bit | | $L_1$/FIRST 1bit | | $L_3$/SECOND 2bit | | $L_7$/THIRD 3bit | | $L_1$/FOURTH 4bit | | $L_2$/FIRST 1bit | | $L_4$/SECOND 2bit | | $L_8$/THIRD 3bit | |

FIG. 22

RAM63, 64

| | | | | | | | | | | | | | | | | |
|---|---|---|---|---|---|---|---|---|---|---|---|---|---|---|---|---|
| INPUT ADDRESS | 0000 | 1000 | 0001 | 1001 | 0002 | 1002 | 0003 | 1003 | 0010 | 1010 | 0011 | 1011 | 0012 | 1012 | 0013 | 1013 |
| INPUT DATA | 000A | 001C | 002A | 003C | 004A | 005C | 006A | 007C | 010A | 011C | 012A | 013C | 014A | 015C | 016A | 017C |
| INPUT DATA | 000B | 001D | 002B | 003D | 004B | 005D | 006B | 007D | 010B | 011D | 012B | 013D | 014B | 015D | 016B | 017D |
| | $L_1$ DATA | | | | | | | | $L_2$ DATA | | | | | | | |

RAM65, 66

| | | | | | | | | | | | | | | | | |
|---|---|---|---|---|---|---|---|---|---|---|---|---|---|---|---|---|
| INPUT ADDRESS | 1000 | 0000 | 1001 | 0001 | 1002 | 0002 | 1003 | 0003 | 1010 | 0010 | 1011 | 0011 | 1012 | 0012 | 1013 | 0013 |
| INPUT DATA | 000C | 001A | 002C | 003A | 004C | 005A | 006C | 007A | 010C | 011A | 012C | 013A | 014C | 015A | 016C | 017A |
| INPUT DATA | 000D | 001B | 002D | 003B | 004D | 005B | 006D | 007B | 010D | 011B | 012D | 013B | 014D | 015B | 016D | 017B |
| | $L_1$ DATA | | | | | | | | $L_2$ DATA | | | | | | | |

FIG. 23

RAM63, 64

| | | | | | | | | | | | | | | | | |
|---|---|---|---|---|---|---|---|---|---|---|---|---|---|---|---|---|
| OUTPUT ADDRESS | 10E0 | 10E1 | 10E2 | 10E3 | 0000 | 0001 | 0002 | 0003 | 0020 | 0021 | 0022 | 0023 | 1060 | 1061 | 1062 | 1063 |
| OUTPUT DATA | 0E1C | 0E3C | 0E5C | 0E7C | 000A | 002A | 004A | 006A | 020A | 022A | 024A | 026A | 061C | 063C | 065C | 067C |
| OUTPUT DATA | 0E1D | 0E3D | 0E5D | 0E7D | 000B | 002B | 004B | 006B | 020B | 022B | 024B | 026B | 061D | 063D | 065D | 067D |
| | $L_{15}$/ FOURTH 4bit | | | | $L_1$ / FIRST 1bit | | | | $L_3$ / SECOND 2bit | | | | $L_7$ / THIRD 3bit | | | |

RAM65, 66

| | | | | | | | | | | | | | | | | |
|---|---|---|---|---|---|---|---|---|---|---|---|---|---|---|---|---|
| OUTPUT ADDRESS | 10E0 | 10E1 | 10E2 | 10E3 | 0000 | 0001 | 0002 | 0003 | 0020 | 0021 | 0022 | 0023 | 1060 | 1061 | 1062 | 1063 |
| OUTPUT DATA | 0E0C | 0E2C | 0E4C | 0E6C | 001A | 003A | 005A | 007A | 021A | 023A | 025A | 027A | 060C | 062C | 064C | 066C |
| OUTPUT DATA | 0E0D | 0E2D | 0E4D | 0E6D | 001B | 003B | 005B | 007B | 021B | 023B | 025B | 027B | 060D | 062D | 064D | 066D |
| | $L_{15}$/ FOURTH 4bit | | | | $L_1$ / FIRST 1bit | | | | $L_3$ / SECOND 2bit | | | | $L_7$ / THIRD 3bit | | | |

DRIVING DEVICE AND DRIVING METHOD OF MATRIX-TYPE DISPLAY APPARATUS FOR CARRYING OUT TIME-DIVISION GRADATION DISPLAY

FIELD OF THE INVENTION

The present invention relates to a driving method of a matrix-type display apparatus with a memory effect, which permits a gradation display.

BACKGROUND OF THE INVENTION

Matrix-type display apparatuses with a memory effect include not only a phase transition liquid crystal display apparatus as disclosed in Japanese Unexamined Patent Application No. 107521/1993 (Tokukaihei 5-107521), but also a ferroelectric liquid crystal display apparatus as disclosed in Japanese Unexamined Patent Application No. 20715/1991 (Tokukaihei 3-20715), a plasma display apparatus as disclosed in Japanese Unexamined Patent Application No. 43829/1994 (Tokukaihei 6-43829), etc.

In general, the matrix-type liquid crystal displays have such characteristics that a selection period is required independently for each scanning electrode, which makes it impossible to select a plurality of scanning electrodes at one time. In each of the described matrix-type display apparatuses, a display is performed by varying a voltage to be applied to the scanning electrode. Specifically, a selection voltage for determining a display state of a pixel is applied, and then a holding voltage for holding the selected display state of the pixel is applied. Lastly, an erase voltage is applied to erase the display state of the pixel. The display state of the pixel can be erased also by stopping the application of the holding voltage.

In the described display apparatuses, a gradation display is enabled, for example, by the scanning method disclosed in Japanese Unexamined Patent Application No. 226178/1988 (Tokukaisho 63-226178). The scanning method will be explained in reference to FIG. 24.

FIG. 24 is a typical depiction of a scanning method of the matrix-type display apparatus including 15 scanning electrodes $L_1$–$L_{15}$, wherein the scanning electrode $L_1$–$L_{15}$ are selected in order according to the numbers (1–60) appended to the top line. To respective blocks, numbers "1" through "4" are appended indicative of the bit numbers of respective data to be applied to pixels on the scanning electrodes $L_1$ through $L_{15}$.

In this example, data is applied from the 1st selection period to the 4th selection period in the following manner. In the 1st selection period, data of the 4th bit is applied to the scanning electrode $L_{15}$, and in the 2nd selection period, data of the 1st bit is applied to the scanning electrode $L_1$. In the 3rd selection period, data of the 2nd bit is applied to the scanning electrode $L_3$, and in the 4th selection period, the data of the 3rd bit is applied to the scanning electrode $L_7$.

In the described method, a scanning operation can be performed with respect to the described display apparatus with a memory effect by applying an erase voltage and a selection voltage in the selection period.

In the described scanning method, it is assumed that the four selection periods are subjected to selection at the same time. Thus, by applying data in the described order, the ratio of the display period $T_1$ of the 1st bit, the display period $T_2$ of the 2nd bit, the display period $T_3$ of the 3rd bit and the display period $T_4$ of the 4th bit is selected to be $T_1$:$T_2$:$T_3$:$T_4$=1:2:4:8.

On the other hand, in the scanning method disclosed in Japanese Unexamined Patent Application No. 56936/1987 (Tokukaisho 62-56936), the ratio of the display periods is selected to be 1:2:4 by altering the blanking period (application period of a reset pulse).

However, the ratio of respective display periods actually derived from FIG. 24 is $T_1$:$T_2$:$T_3$:$T_4$=3:7:15:35. This ratio can be altered depending on which one of the 1st through 4th bits is applied in the 1st selection period. In the described scanning period, it is merely assumed as if a plurality of scanning electrodes were subject to selection at the same time although the plurality of scanning electrodes are, in fact, selected sequentially. Thus, it is not possible to adjust the ratio of the display periods to be exactly 1:2:4:8 (=4:8:16:32).

In the latter example of the scanning method, more than 30 percent of all the selection periods is not related to the brightness, and a sufficient brightness cannot be ensured.

SUMMARY OF THE INVENTION

An object of the present invention is to provide a scanning method which enables a ratio of display periods to be exactly 1:R: . . . :$R^{n-1}$ (n is an integer of not less than 2) in substantially the same scanning time as the described conventional scanning methods. Another object of the present invention is to provide a suitable memory control method for the described gradation display to be applied to the matrix-type liquid crystal display, which permits data in response to a random display period to be outputted at high speed.

In order to achieve the above objects, the first driving method of a matrix-type display apparatus which permits a time-division gradation display, designed for the matrix-type display apparatus having a memory effect which permits a gradation display with a number of gradations R (R is an integer of not less than 2), the matrix-type display apparatus including m scanning electrodes and a plurality of signal electrodes which cross each other, the driving method is characterized by including the steps of:

(i) scanning the m scanning electrodes n times in one frame under such condition that a time ratio of the 1st, 2nd, . . . , the nth display periods (n is an integer of not less than 2) is X:RX: . . . :$R^{n-1}$X (X is a positive integer) based on R and n which satisfy $$ROT_n(X) \neq ROT_n((1+R)X)$$

$$ROT_n(X) \neq ROT_n((1+R+R^2)X) \ldots$$

$$ROT_n(X) \neq ROT_n((1+R+\ldots+R^{1-n})X)=0$$

$$ROT_n((1+R)X) \neq ROT_n((1+R+R^2)X) \ldots$$

$$ROT_n((1+R+\ldots+R^{n-2})X) \neq ROT_n((1+R+\ldots+R^{n-1})X)=0 \qquad \ldots (1)$$

wherein $ROT_n(a)$ is a remainder when dividing a (a is 0 or a positive integer) by n, and X which satisfies $$(1+R+\ldots+R^{n-1})X=n(m+b) \qquad \ldots (2),$$

wherein b is 0 or a positive integer; and (ii) supplying data assigned to the 1st, 2nd, . . . , the nth display periods to the signal electrodes respectively in ath, (X+a)th, . . . [(1+R+. . .+$R^{n-2}$)X+a]th selection periods.

In general, the matrix-type display apparatus having a memory effect requires an independent selection period for each scanning electrode. For this deficiency, it is not permitted to select a plurality of scanning electrodes at one time.

Thus, in order to scan the m scanning electrodes n times in one frame, at least n×m selection periods are needed. While to enable a time-division gradation display with time ratio of display periods of X:RX: . . . :$R^{n-1}$X, (1+R+. . . +$R^{n-1}$)X periods are required. Thus, an integer b is assigned to obtain the formula (2).

The formula (1) holds, for example, when the following conditions are satisfied:

$$pn \neq R,\ R^2,\ R+R^2,\ \ldots,\ 1+R+\ldots+R^{n-1} \quad \ldots (3)$$

and $$ROT_n(X)=ROT_n(RX)=ROT_n(R^2X)=\ldots$$
$$=ROT_n(R^{n-2}X)=ROT_n(R^{n-1}X)\neq 0 \ldots \quad (4)$$

In the formula (3), p is a positive integer.

When the described conditions are satisfied, the correlation defined by the formula (1) is such that respective values $ROT_n$(X), $ROT_n$((1+R)X), . . . , $ROT_n$((1+R+. . .+$R^{n-2}$)X), $ROT_n$((1+R+. . .+$R^{n-1}$)X) are determined so as to have one to one correspondence such as 1, 2, . . . , n−1, 0.

When R and n which satisfy the formula (1) are specified, X is determined in accordance with the number of scanning electrodes m from the formula (2). As a result, in the step (i), the m scanning electrodes can be scanned n times in one frame period with time ratio of the 1st, 2nd, . . . the nth display periods of X:RX: . . . :$R^{n-1}$X. In the step (ii), the data assigned respectively to the 1st, 2nd, . . . the nth display periods are supplied to the signal electrodes respectively in the ath, the (X+a)th, . . . , the [(1+R+. . .+$R^{n-2}$)X+a]th selection periods.

As a result, in the scanning electrode $L_1$, the data assigned respectively to the 1st through the nth display periods are displayed in the ath, the (X+a)th, . . . , the [(1+R+. . . +$R^{n-2}$)X+a] selection periods. In the scanning electrode $L_d$, the data assigned respectively to the 1st through the nth display periods are displayed in the (d×n+a)th, the (d×n+X+a)th, . . . the (d×n+(1+R+. . . +$R^{n-2}$)X+a)th selection periods respectively.

In the data assigned respectively to the 1st, 2nd, . . . , the nth display periods are always displayed in the (d×n+a)th, the (d×n+X+a)th, . . . the [d×n+(1+R+. . .+$R^{n-2}$)X+a]th selection periods respectively. This permits m scanning electrodes to be scanned without overlapping the respective selection periods corresponding to these data. As a result, a gradation display can be performed with the time ratio of the respective display periods of exactly X:RX: . . . :$R^{n-1}$X, while improving a display quality. Here, d is a random integer.

In order to achieve the aforementioned object, the second driving method of a matrix-type display apparatus which permits a time-division gradation display, designed for the matrix-type display apparatus having a memory effect which enables a gradation display with a number of gradations R (R is an integer of not less than 2), the matrix-type display apparatus including m scanning electrodes and a plurality of signal electrodes which cross each other, is characterized by including the steps of:

(i) scanning the m canning electrodes n times in one frame in such a manner that a time ratio of the 1st, 2nd, . . . , the nth display periods (n is an integer of not less than 2) is X:RX: . . . :$R^{n-1}$X (X is a positive integer) based on R and n which satisfy $$ROT_n(X+Y)\neq ROT_n((1+R)X+2Y)$$
$$ROT_n(X+Y)\neq ROT_n((1+R+R^2)X+3Y) \ldots$$
$$ROT_n(X+Y)\neq ROT_n((1+R+\ldots+R^{n-1})X+(n-1)Y)=0$$
$$ROT_n((1+R)X+2Y)\neq ROT_n((1+R+R^2)X+3Y) \ldots$$
$$ROT_n((1+R+\ldots+R^{n-2})X+(n-1)Y)\neq ROT_n((1+R+\ldots+R^{n-1})X)=0 \ldots (5)$$

wherein $ROT_n$(a) is a remainder when dividing a (a is 0 or a positive integer) by n, and X+Y is a positive integer, and X and Y which satisfy $$(1+R+\ldots+R^{n-1})X+nY=n(m+b) \quad \ldots (6)$$

wherein b is 0 or a positive integer; and (ii) supplying data assigned to the 1st, 2nd, . . . , the nth display periods to the signal electrodes respectively in the ath, the (X+Y+a)th, . . . , the [(1+R+. . .+$R^{n-2}$)X+(n−1)Y+a]th selection periods.

As aforementioned, in the matrix-type display apparatus having a memory effect, a holding voltage for holding the display state of a pixel is applied after a selection voltage is applied, and then an erase voltage is applied to erase the display state of the pixel. In the matrix-type display apparatus of the described arrangement, while a selection voltage is being applied to a scanning electrode, an erase voltage can be applied to another scanning electrode. This permits the blanking periods to be formed independently of the selection periods for scanning the electrodes.

Thus, to enable a time-division gradation display with the time ratio of respective selection periods of X:RX: . . . :$R^{n-1}$X, . . . , (1+R+. . .+$R^{n-1}$)X+nY periods (Y is a blanking period) are needed. While in order to scan m scanning electrodes n times in one frame, at least n×m selection periods are needed.

Thus, an integer b is assigned, and the formula (6) is obtained.

The formula (5) holds, for example, when the following condition is satisfied:

$$ROT_n(X+Y)=ROT_n(RX+Y)=ROT_n(R^2X+Y)=\ldots$$
$$=ROT_n(R^{n-2}X+Y)=ROT_n(R^{n-1}X+Y)\neq 0 \quad \ldots (7)$$

The formula (7) holds, for example, when the following condition is satisfied:

$$qn=(R-1)X \quad \ldots (8).$$

Here, q is a positive integer. When described conditions are satisfied, the correlation defined by the formula (5) is such that respective values for $ROT_n$(X+Y), $ROT_n$((1+R)X+2Y), . . . , $ROT_n$((1+R+. . .+$R^{n-2}$)X)+(n+1)Y), $ROT_n$((1+R+. . .+$R^{n-1}$)X+nY) are determined so as to have one to one correspondence such as 1, 2, . . . n−1, 0.

To hold the formula (5), from $ROT_n$(X+Y)≠0, X+Y cannot be a multiple of n.

Thus, X+Y is determined according to the number of scanning electrodes m based on the formula (9) and the formula (6), wherein M is a least common multiple of X+Y and n.

$$M=n(X+Y) \quad \ldots (9)$$

As a result, in the step (i), the scanning electrode is scanned n times in one frame period with a time ratio of the 1st, 2nd, . . . the nth display periods of X:RX: . . . :$R^{n-1}$X. In the step (ii), the data respectively assigned to the 1st through the nth display periods are supplied in the ath, the (X+Y+a)th, . . . the [(1+R+. . .+$R^{n-2}$)X+(n−1)Y+a]th display periods respectively.

As a result, for example, in the scanning electrode $L_1$, the data assigned respectively to the 1st through the nth display periods are displayed in the ath, the (X+Y+a)th, . . . , the $[(1+R+. . .+R^{n-2})X+(n-1)Y+a)]$th display periods. In the scanning electrode $L_d$, the data assigned respectively to the 1st through the nth display periods are displayed respectively in the (d×n+a)th, the (d×n+X+Y+a)th, . . . , the $[d\times n+(1+R+. . .+R^{n-2})X+(n-1)Y+a]$th selection periods.

Thus, the described arrangement permits the data assigned respectively to the 1st, 2nd, . . . , the nth display periods to be always displayed respectively in the (d×n+a)th, the (d×n+X+Y+a)th, . . . the $[d\times n+(1+R+. . .+R^{n-2})X+(n-1)Y+a]$th selection periods. This permits m scanning electrodes to be scanned without overlapping the respective selection periods corresponding to these data. By assigning the blanking period to Y, the period which is not subject to the brightness can be reduced to the minimum. As a result, a gradation display can be performed with a time ratio of exactly X:RX: . . . :$R^{n-1}$X, while improving a display quality. Here, d is a random integer.

The described first and second driving methods may be arranged so as to have g×m scanning electrodes by replacing one scanning electrode by a group of g scanning electrodes (g is an integer of not less than 2) and to scan the group of the g scanning electrodes in one selection period. In this case, the first and second driving methods can be applied to a large-area matrix-type display apparatus having a greater number of scanning electrodes.

In order to achieve the aforementioned object, the third driving method of a matrix-type display apparatus which permits a time-division gradation display, designed for a matrix-type display apparatus with a memory effect which permits a gradation display with a number of gradations R (R is an integer of not less than 2), the matrix-type display apparatus including a plurality of scanning electrodes and a plurality of signal electrodes which cross each other, the driving method is characterized by including the steps of:

(i) scanning the plurality of scanning electrodes n times in one frame in such a manner that a time ratio of the 1st, 2nd, . . . , the nth display periods (n is an integer of not less than 2) is X:RX: . . . :$R^{n-1}$X (X is a positive integer);

(ii) storing data respectively assigned to the 1st, 2nd, . . . , the nth display periods in a plurality of memory blocks; and (iii) outputting the data from the plurality of memory blocks together at a display period of each scanning electrode, whereby the data is supplied to the plurality of signal electrodes.

In the conventional memory device, n groups of gradation display data respectively assigned the 1st, 2nd, . . . , the nth display periods of the pixel $A_{ij}$ are stored at the same address. Therefore, for example, even when reading the gradation display data assigned to the 1st display period from the memory device, the gradation display data assigned to the 2nd, . . . , the nth display data are also read. The same problem, i.e., the unwanted gradation display data is read occurs when reading gradation display data assigned respectively to the 2nd, . . . , the nth display periods. Thus, in order to read n groups of gradation display data, it is required to input the same address n times.

In contrast, in the third driving method of the present invention, a plurality of memory blocks (for example, n memory blocks) which permit respective addresses to be inputted independently are considered to be one memory device. Thus, by adopting such memory blocks in the step (ii), n groups of data (gradation display data) assigned to the 1st through the nth display periods of the pixel $A_{ij}$ are stored in n memory blocks at different addresses.

According to the described arrangement, in the case of reading the data assigned to the 1st display period from the 1st memory block, by inputting the same address in the 2nd, . . . , the nth memory block, the data assigned to the 1st display period of different pixels in the same scanning electrode can be read by the step (iii).

In the described manner, such problem that unwanted data is read from respective memory blocks is eliminated. This permits n groups of data to be read by inputting the same address only once.

As described, by outputting the data together at a display period of each scanning electrode, the number of times the data is read from the memory blocks in respective display periods can be reduced. As this permits the data assigned to a random display period to be supplied to the corresponding signal electrode at high speed, a time-division gradation display can be performed desirably.

According to the described driving method, the same effect can be achieved by the following arrangements: n groups of data assigned respectively to the 1st, 2nd, . . . , the nth display periods of the pixel $A_{ij}$ are stored in n memory blocks at the same address; and, for example, the data corresponding to the 1st display period is read from the 1st memory block, by inputting different addresses respectively in the 2nd, . . . , the nth memory blocks, the gradation display data assigned to the 1st display period of other pixel of the same scanning electrode are read.

In order to achieve the above object, a matrix-type display apparatus having a memory effect which permits a multiplex gradation display with a number of gradations R (R is an integer of not less than 2), the matrix-type display apparatus including a plurality of scanning electrodes and a plurality of signal electrodes, the scanning electrodes crossing the signal electrodes, is characterized by including:

a scanning electrode driving circuit for scanning the plurality of scanning electrodes n times in one frame in such a manner that a time ratio of the 1st, 2nd, . . . , the nth display periods (n is an integer of not less than 2) is X:RX: . . . :$R^{n-1}$X (X is a positive integer);

a signal electrode driving circuit for supplying data assigned to respective display periods to the signal electrodes respectively in the selection periods of the scanning electrode;

a plurality of memory blocks which permit addresses to be inputted independently, the plurality of memory blocks storing the data in respective display periods of scanning electrodes using a common address;

a distribution circuit for distributing the data to the respective memory blocks; and a control circuit for storing distributed data using addresses which are different among groups, each group being constituted by not less than two memory block and reading the data from each memory block at the same address, whereby the data is outputted to the signal electrode driving circuit.

In the described arrangement, the gradation display data assigned to one pixel are distributed into respective memory blocks as n groups of gradation display data assigned to the n display periods by the distribution circuit and are stored in these memory blocks under the control of the control circuit. The memory control by the control circuit is performed, for example, in the following manner. N groups of gradation display data assigned to the 1st, 2nd, the nth display periods of the pixel $A_{ij}$ are stored in the n memory blocks respectively at different addresses. Additionally, for example, when reading out the gradation display data assigned to the 1st display period from the 1st memory block, by inputting the same address in the 2nd, . . . , the nth memory blocks, the gradation display data assigned to the 1st display period of other pixels of the same scanning electrode can be read.

Under the described control, by inputting the common address among the display periods of each scanning electrode to each memory block simultaneously, when scanning the scanning electrodes, the data corresponding to respective scanning electrodes can be read together at each display period. Thus, the number of times the data is read from the memory block in each display period can be reduced. Further, as this permits the data assigned to a random display period to be supplied to the corresponding signal electrode at high speed, the time-division gradation display can be performed desirably.

The novel features which are considered as characteristic of the invention are set forth in particular in the appended claims. The improved treatment method, as well as the construction and mode of operation of the improved treatment apparatus, will, however, be best understood upon perusal of the following detailed description of certain specific embodiments when read in conjunction with the accompanying drawings.

BRIEF DESCRIPTION OF THE DRAWINGS

FIG. 18 is an explanatory view showing input data and input address to be inputted to the memory device.

FIG. 19 is an explanatory view showing output data and output address to be outputted from the memory device.

FIG. 22 is an explanatory view showing input data and input address to be inputted to the memory device of FIG. 21.

FIG. 23 is an explanatory view showing output data and output address to be outputted from the memory device of FIG. 21.

DESCRIPTION OF THE EMBODIMENTS

The following descriptions will discuss one embodiment of the present invention in reference to FIG. 1 through FIG. 23.

[Basic Structure of Ferroelectric Liquid Crystal Display Apparatus]

Figure 8:
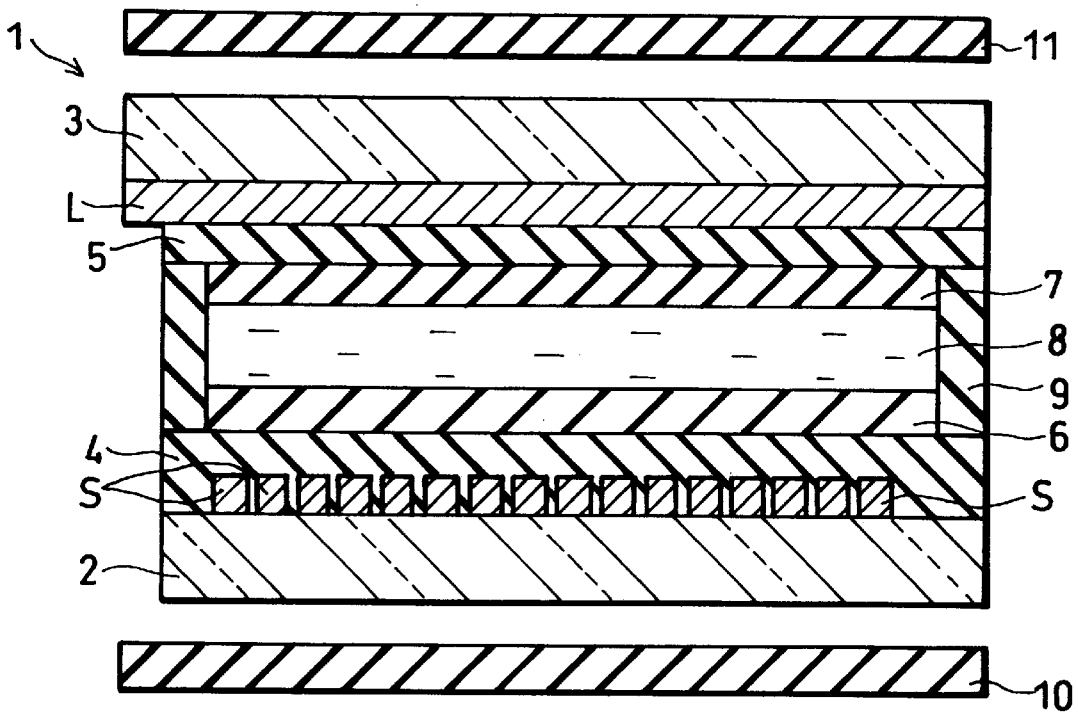
FIG. 8 is a cross-sectional view showing the structure of a liquid crystal panel provided in the FLCD in accordance with one embodiment of the present invention.

As shown in FIG. 8, a ferroelectric liquid crystal display apparatus (hereinafter referred to as FLCD) in accordance with the present embodiment includes a liquid crystal panel 1. The liquid crystal panel 1 is composed of substrates 2 and 3 made of, for example, light transmissive glass placed so as to oppose each other.

On the surface of the substrate 2, a plurality of transparent signal electrodes S made of, for example, indium tin oxide (hereinafter referred to as ITO), etc., are formed in parallel. The described signal electrodes S are covered with a transparent insulating film 4 made of, for example, silicone oxide ($SiO_2$).

On the surface of the substrate 3, a plurality of transparent scanning electrodes L made of, for example, ITO, are formed in parallel so as to cross the signal electrodes S at right angle. These scanning electrode L are covered with a transparent insulating film 5 made of the same material as the insulating film 4.

On the insulating films 4 and 5, orientation films 6 and 7 having gone through a uniaxial orientation process such as a rubbing process, etc., are formed. For the orientation films 6 and 7, for example, polyvinyl alcohol, etc., may be used.

The glass substrates 2 and 3 are put together by a sealing agent 9 so as to oppose each other with a predetermined interval (cell gap) on the side of the orientation films 6 and 7. The ferroelectric liquid crystal 8 as a display medium is filled in a space between the glass substrates 2 and 3, thereby forming a liquid crystal layer. The ferroelectric liquid crystal 8 is filled through a filling hole (not shown) formed in the sealing agent 9 and is sealed by closing the hole.

The substrates 2 and 3 are sandwiched by two polarization plates 10 and 11 which are placed in such a manner that respective planes of polarization cross at right angle.

Figure 9:
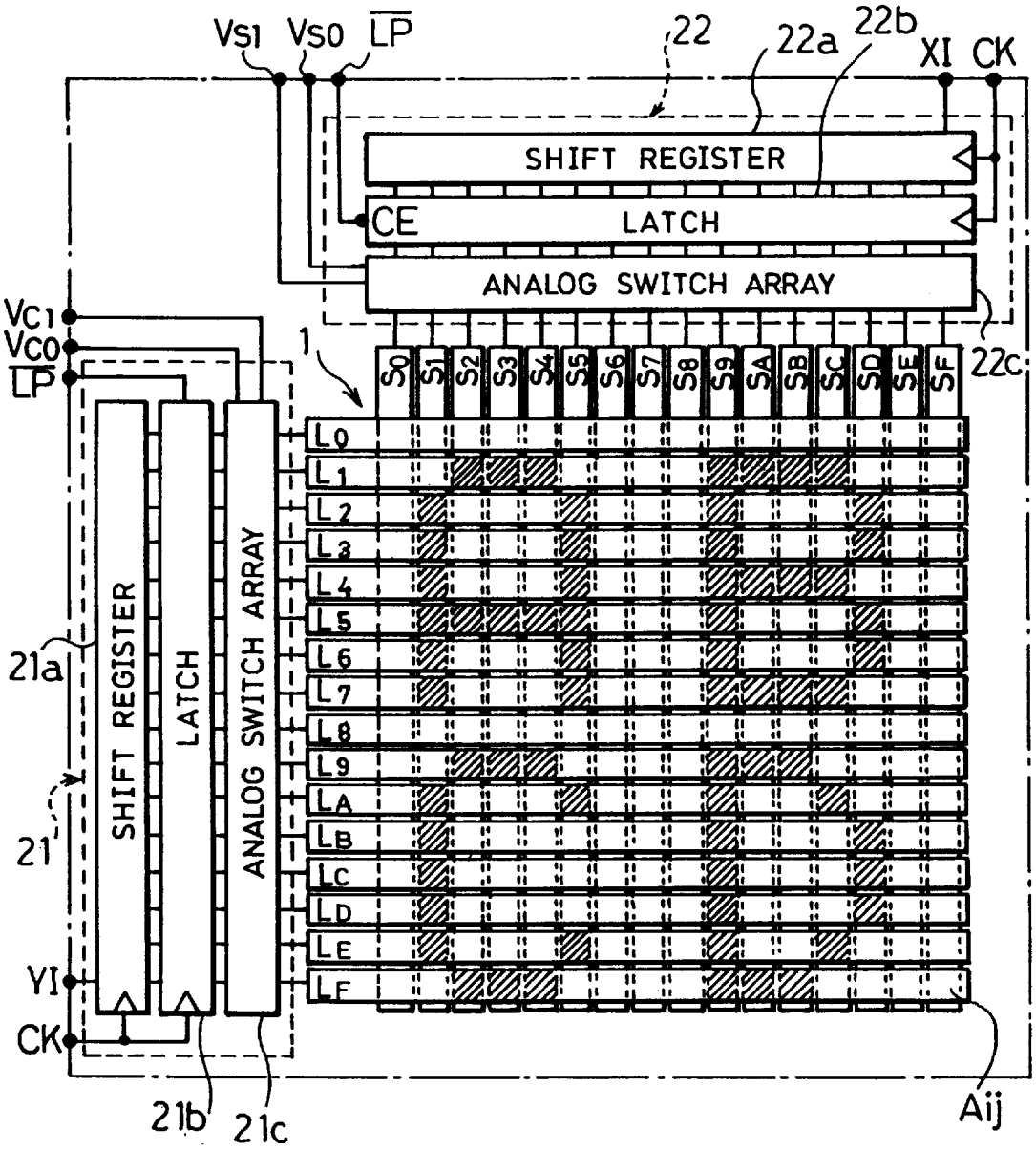
FIG. 9 is a plan view showing a structure of essential parts of the FLCD including the liquid crystal panel of FIG. 8.

As shown in FIG. 9, the scanning electrodes L ($L_0$ through $L_F$) are connected to a scanning electrode driving circuit 21, and the signal electrodes S ($S_0$ through $S_F$) are connected to a signal electrode driving circuit 22. For simplification, the liquid crystal panel 1 illustrated in FIG. 9 includes 16 scanning electrodes L and 16 signal electrodes S so as to form 16×16 pixels.

In the following explanations, a pixel in which a random scanning electrode $L_i$ (i=0 to F) and a random signal electrode $S_j$ (j=0 to F) cross is denoted as a pixel $A_{ij}$.

The scanning electrode driving circuit 21 is provided for applying a voltage to the scanning electrodes L, and includes a shift register 21*a*, a latch 21*b* and an analog switch array 21*c*. In the scanning electrode driving circuit 21, a 1-bit scanning signal YI is transferred from the shift register 21*a* based on a clock CK, and is outputted from each output terminal of the shift register 21*a* to be held in the latch 21*b* in sync with a latch pulse LP of the negative logic.

When the value held by the latch 21*b* is significant (for example, high level), the analog switch array 21*c* applies a selective voltage $V_{c1}$ to the scanning electrode $L_i$ connected to a signal line from which the value is outputted. On the other hand, when the value held by the latch 21*b* is insignificant (for example, low level), the analog switch array 21*c* applies a non-selective voltage $V_{C0}$ to the scanning electrode $L_k$ (k≠i) connected to a signal line from which the value is outputted.

The scanning electrode driving circuit 21 is arranged so as to scan the scanning electrodes L a plurality of times in one frame period based on the scanning signal YI so as to enable any one of the below-discussed first through sixth scanning methods.

The signal electrode driving circuit 22 is provided for applying a voltage to the signal electrodes S, and includes a shift register 22*a*, a latch 22*b* and an analog switch array 22*c*. In the signal electrode driving circuit 22, a data signal XI is transferred from the shift register 22*a* based on a clock CK, and is outputted from each output terminal of the shift register 22*a* to be held by the latch 22*b* in sync with the latch pulse LP of the negative logic.

When the value held by the latch 22*b* is significant (for example, high level), the analog switch array 22*c* applies an active voltage $V_{s1}$ to the signal electrode $S_i$ connected to a signal line from which the value is outputted. On the other hand, when the value held by the latch 22*b* is insignificant (for example, low level), the analog switch array 22*c* applies a non-active voltage $V_{S0}$ to the signal electrode $S_k$ (k≠j) connected to a signal line from which the value is outputted.

The signal electrode driving circuit 22 supplies data assigned to a display period for scanning each scanning electrode L to the signal electrode S in the selection period defined in the below-discussed 1st through 6th scanning periods.

Figure 10A:
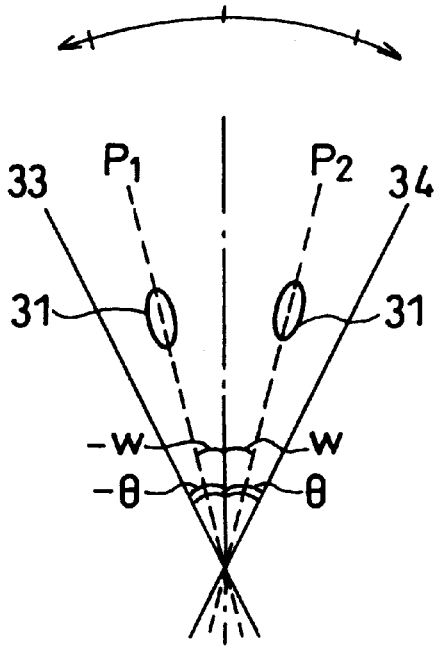
FIGS. 10(*a*) (*b*) are a plan view and a perspective view showing behavior of a ferroelectric liquid crystal molecule sealed in the liquid crystal panel of FIG. 8.
Figure 10B:
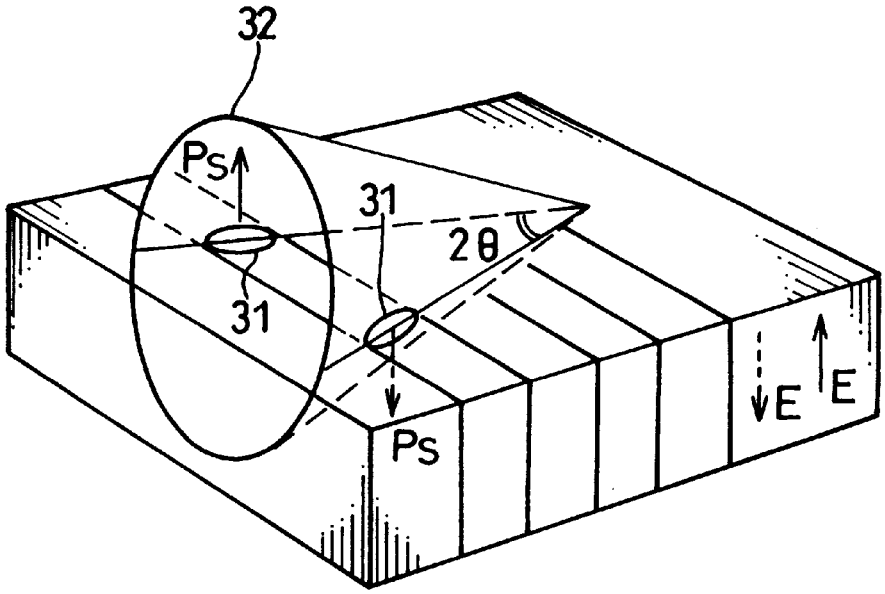

As shown in FIG. 10(*b*), the liquid crystal molecule 31 sealed in the pixel $A_{ij}$ has a spontaneous polarization $P_S$ in a direction perpendicular to a major axis direction. The liquid crystal molecule 31 receives a force in proportion to a vector product of an electric field E generated by a potential difference between an application voltage to the scanning electrode L and an application voltage to the signal electrode S and the spontaneous polarization $P_S$. As a result, the liquid crystal molecule 31 is moved on the surface of a circular cone 32 having an apex angle 2θ that is two times as large as the tilt angle.

On the other hand, as shown in FIG. 10(*a*), when the liquid crystal molecule 31 is moved to an axis 33 by the electric field E, the liquid crystal molecule 31 becomes stable at position $P_1$. When the liquid crystal molecule 31 is further moved to an axis 34 by the electric field E, the liquid crystal molecule 31 becomes stable at position $P_2$. Namely, the liquid crystal molecule 31 has the described two stable states.

Even if the liquid crystal molecule 31 is further moved by the electric field E, as long as the positions $P_1$ and $P_2$ do not vary, a restoring force is exerted onto the liquid crystal molecule 31 to be moved back to the original stable state.

Here, by making a plane of polarization of either one of the polarization plates 10 and 11 shown in FIG. 8 to coincide with either one of the axes 33 and 34, two display states can be achieved. Specifically, the pixel $A_{ij}$ having the liquid crystal molecule 31 in one stable state is in a bright display state, while the pixel $A_{ij}$ having the liquid crystal molecule in the other stable state is in the dark display state.

Not only the force generated by the electric field E but also a force in proportion to a product of a dielectric anisotropy Δ∈ indicative of a difference in dielectric constant between the major axis direction and the minor axis direction of the molecule and the electric field E power to the two are exerted onto the liquid crystal molecule 31. Thus, the force exerted onto the liquid crystal molecule 31 is shown by the following formula:

$$P=K_0\times P_S\times E+K_1\times\Delta\in\times E^2,$$

wherein $K_0$ and $K_1$ are constants.

For this reason, in the liquid crystal panel 1 in which an FLC material having a negative dielectric anisotropy Δ∈ is sealed, in the state where the electric field E is increased to a predetermined electric field $E_{min}$, if an increase in force by the negative dielectric anisotropy Δ∈ becomes greater than an increase in force by the spontaneous polarization $P_S$, the force exerted onto the liquid crystal molecule 31 is maximized under an applied electric field $E_{min}$. On the other hand, as a memory pulse width is known to be in reverse proportion to the force exerted onto the liquid crystal molecule 31, the memory pulse width is minimized under an applied electric field $E_{min}$.

As the driving method of the FLCD utilizing the described characteristics, for example, JOERS/Alvey drive scheme (hereinafter referred to as a J/A drive scheme) is reported in "The JOERS/Alvey Ferroelectric Multiplexing Scheme" (Ferroelectrics, 1991, Vol. 122, pp. 63–79) reported in the FLC international conference (1991). The characteristics of voltage vs memory pulse width of the SCE 8 that is a FLC material available from Merck Ltd. described in the paper are shown in FIG. 11.

Figure 11:
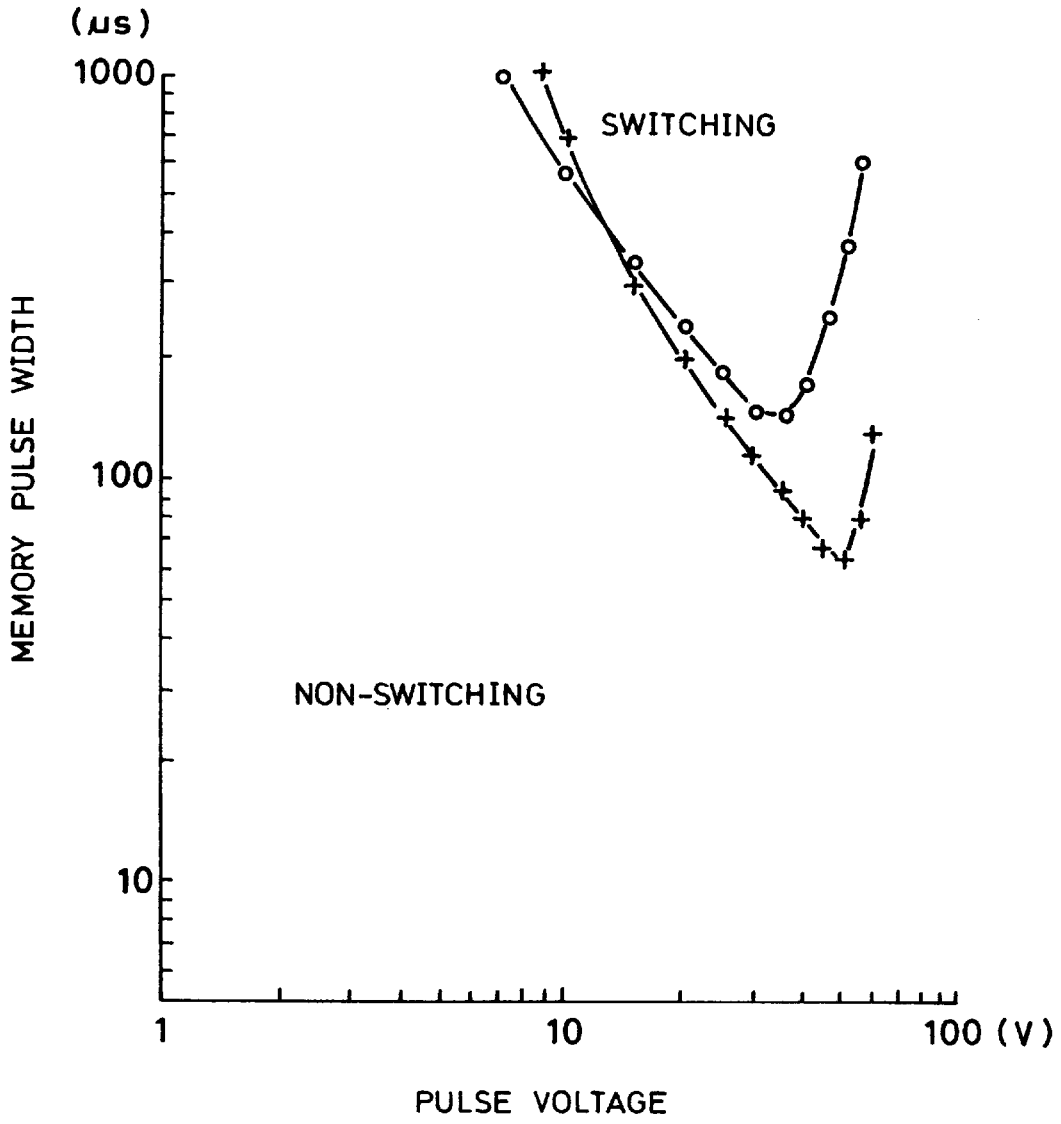
FIG. 11 is a graph showing switching characteristics of the ferroelectric liquid crystal.
Figure 12A:
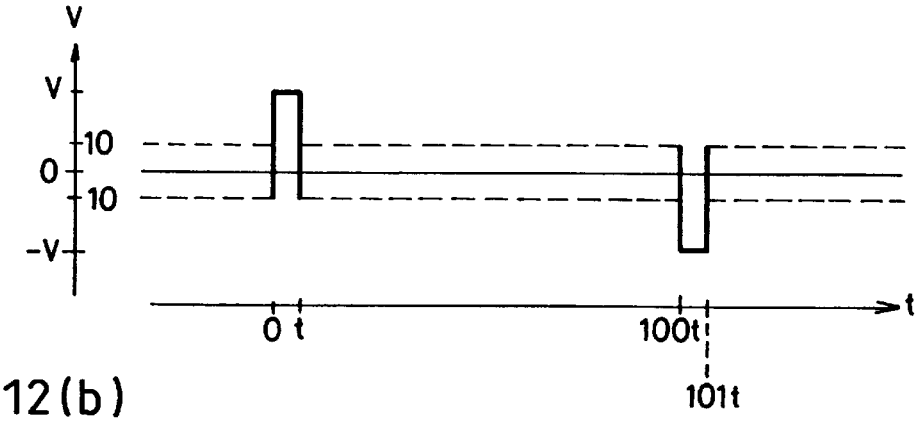
FIGS. 12(*a*) (*b*) are waveform diagrams showing a waveform of a pulse voltage for use in determining the switching characteristics of FIG. 11.
Figure 12B:
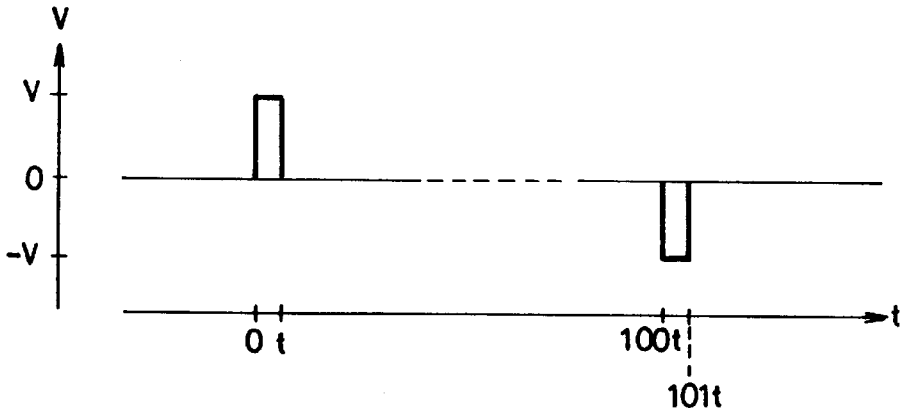

The circled data in FIG. 11 were measured while superimposing thereon a bias voltage of ±10 V shown in FIG. 12(*a*). On the other hand, in FIG. 11, the data marked+were measured while superimposing thereon a bias voltage of ±0 V shown in FIG. 12(*b*).

Figure 13A:
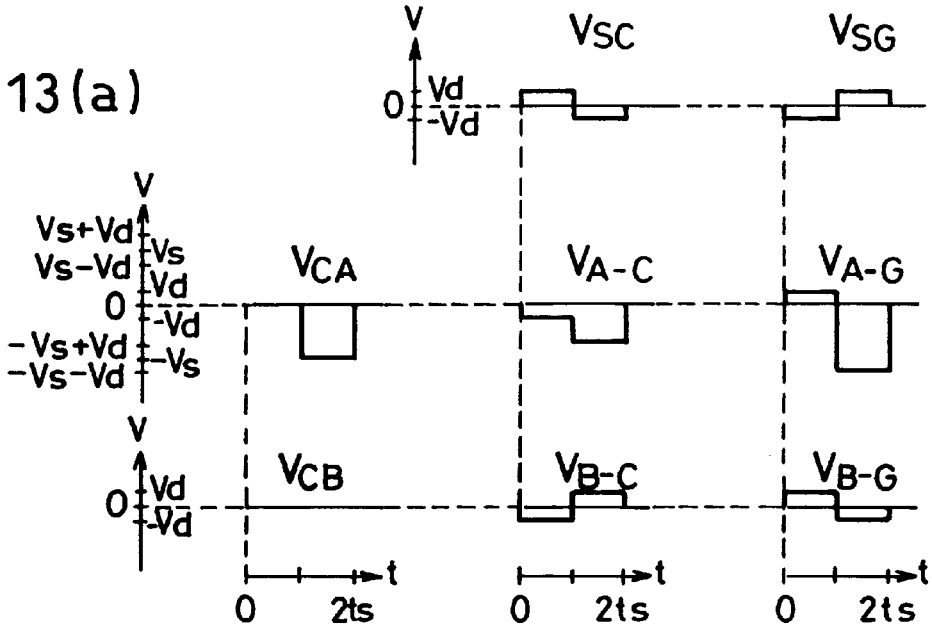
FIGS. 13(*a*) (*b*) are waveform diagrams showing a waveform of a drive voltage in the 1st and 2nd fields in the JOERS/Alvey scheme applied to the FLCD.
Figure 13B:
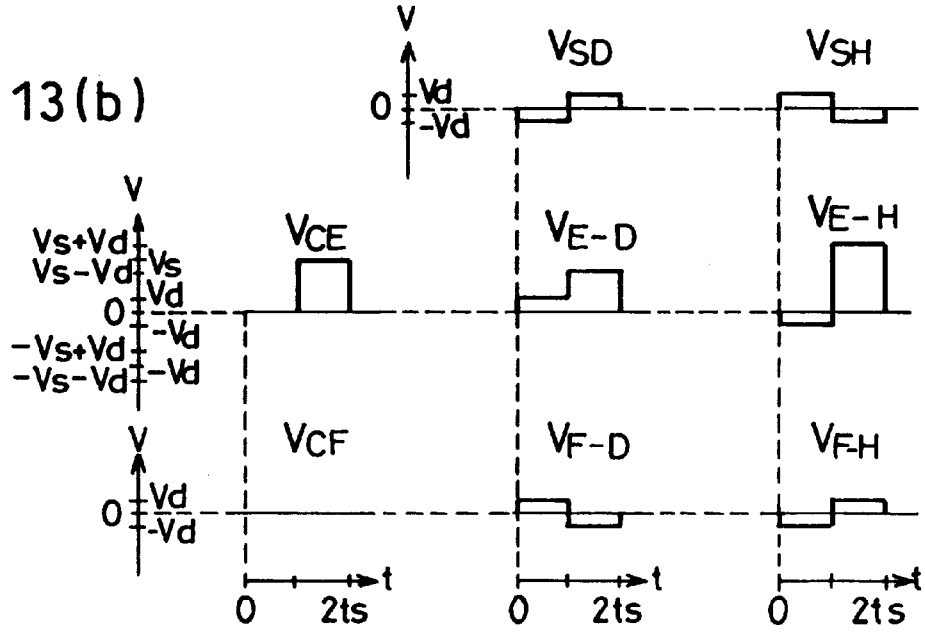

In the described driving method, the data in one screen is rewritten by scanning two fields. In the 1st field, as shown in FIG. 13(*a*), a voltage $V_{SC}$ is applied to the signal electrode $S_j$ when the selective voltage $V_{CA}$ is applied to the scanning electrode $L_i$, thereby applying a voltage $V_{A-C}$ to the liquid crystal molecule 31 in the pixel $A_{ij}$. As a result, the liquid crystal molecule 31 can be switched to one stable state.

In the 2nd field, as shown in FIG. 13(*b*), a voltage $V_{SH}$ is applied to the signal electrode $S_j$ when the selective voltage $V_{CE}$ is applied to the scanning electrode $L_i$, thereby applying a voltage $V_{E-H}$ to the liquid crystal molecule 31 in the pixel $A_{ij}$. As a result, the liquid crystal molecule 31 is kept in the current stable state.

The liquid crystal molecule 31 is switched from one stable state to the other stable state in the following manner. In the 1st field, as shown in FIG. 13(*a*), a voltage $V_{SG}$ is applied to the signal electrode $S_j$ when the selective voltage $V_{CA}$ is applied to the scanning electrode $L_i$, thereby applying the voltage $V_{A-G}$ to the liquid crystal molecule 31 in the pixel $A_{ij}$. As a result, the liquid crystal molecule 31 is kept in the current stable state.

As shown in FIG. 13(*b*), in the 2nd field, a voltage $V_{SD}$ is applied to the signal electrode $S_j$ when the selective voltage $V_{CE}$ is applied to the scanning electrode $L_i$, thereby applying the voltage $V_{E-D}$ to the liquid crystal molecule 31 in the pixel $A_{ij}$. As a result, the liquid crystal molecule 31 in one stable state is switched to the other stable state.

While the liquid crystal molecule 31 in other pixel $A_{kj}$ ($k \neq i$) is being switched from one stable state to the other stable state, the voltage is applied in the following manner.

As shown in FIG. 13(*a*), in the 1st field, the non-selective voltage $V_{CB}$ is applied to the scanning electrode $L_i$ when the voltage $V_{SC}$ or the voltage $V_{SG}$ is applied to the signal electrode $S_j$, thereby applying the voltage $V_{B-C}$ or the voltage $V_{B-G}$ to the liquid crystal molecule 31 in the pixel $A_{ij}$. As shown in FIG. 13(*b*), in the 2nd field, the non-selective voltage $V_{CF}$ is applied to the scanning electrode $L_i$ when the voltage $V_{SD}$ or the voltage $V_{SH}$ is applied to the signal electrode $S_j$, thereby applying the voltage $V_{F-D}$ or the voltage $V_{F-H}$ to the liquid crystal molecule 31 in the pixel $A_{ij}$. As a result, the stable state of the liquid crystal molecule 31 does not vary irrespectively of the applied voltage to the signal electrode $S_j$.

The described driving method is applicable when the following conditions are satisfied:

Condition 1: Absolute values of the voltage levels $-V_s+V_d$ and $V_s-V_d$ which respectively determine the voltages $V_{A-C}$ and $V_{E-D}$ shown in FIGS. 13(*a*) (*b*) indicate voltages of around 40 (V) in the characteristic diagram shown in FIG. 11 in which the force exerted onto the liquid crystal molecule 31 is in a vicinity of the maximum value; and Condition 2: Absolute values of the voltage levels $-V_s-V_d$ and $V_s+V_d$ which respectively determine the voltages $V_{A-G}$ and $V_{E-H}$ shown in FIGS. 13(*a*) (*b*) are voltages of around 60 (V) which are in a region where the force exerted onto the liquid crystal molecule 31 reduces from the maximum value in the characteristic diagram shown in FIG. 11.

Thus, the force exerted onto the liquid crystal molecule 31 with an applied voltage under the condition 1 becomes larger than the force exerted onto the liquid crystal molecule 31 with an applied voltage under the condition 2.

In order to apply the described driving method, the following conditions are also required:

The voltage $V_{A-C}$ takes two levels $-V_d$ and $-V_s+V_d$ which are of the same polarity, and the voltage $V_{E-D}$ takes two voltage levels $V_d$ and $V_s-V_d$ which are of the same polarity. On the other hand, the voltage $V_{A-G}$ takes two voltage levels $V_d$ and $-V_s-V_d$ which are of opposite polarities, and the voltage $V_{E-H}$ takes two voltage levels $-V_d$ and $V_s+V_d$ which are of opposite polarities. In the case of the same polarity, voltage levels $-V_s+V_d$ and $V_s-V_d$ which permit the voltage level to be switched to respective stable levels with ease are selected. On the other hand, in the case of opposite polarities, voltage levels $-V_s-V_d$ and $V_s+V_d$ which do not permit the voltage level to be switched to respective stable levels as ease as the case of the same polarity are selected.

Figure 14:
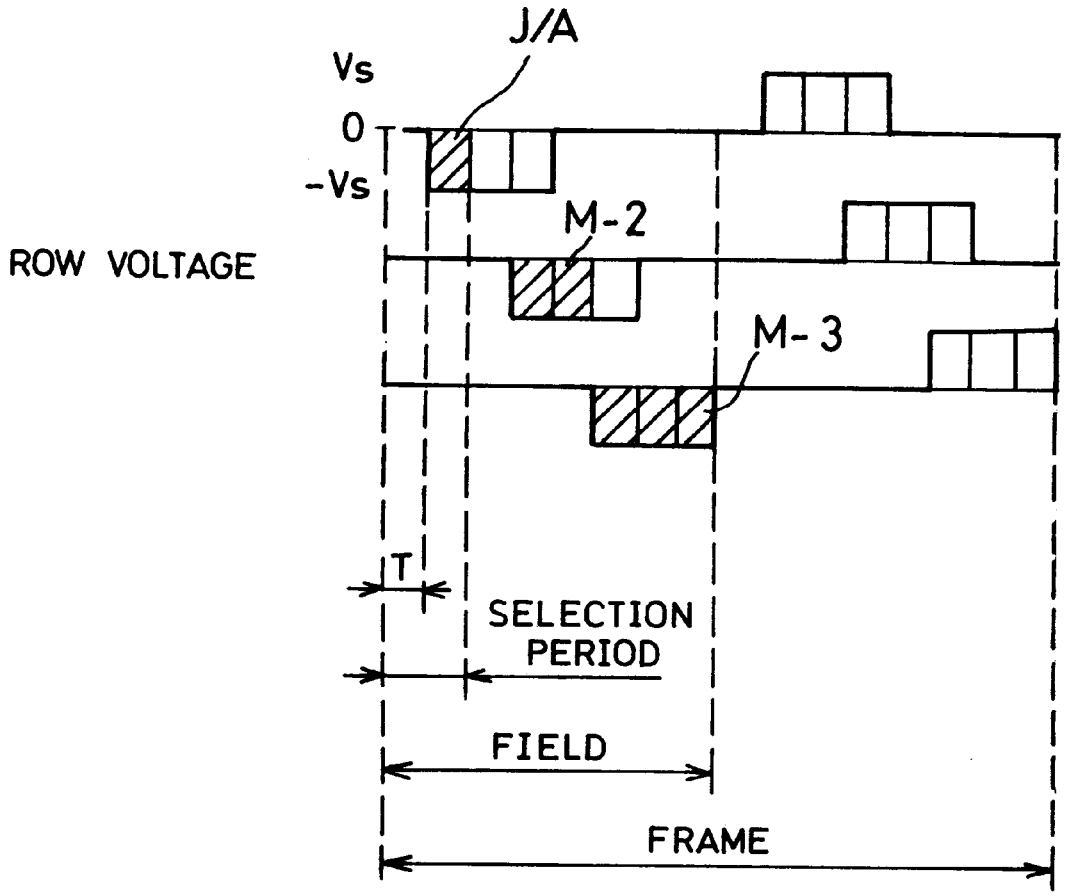
FIG. 14 is a waveform diagram showing respective waveforms of a column voltage in the Malvern drive scheme and a column voltage in the JOERS/Alvey drive scheme which are applied to the FLCD.

The J/A drive scheme has been developed, for example, as a Malvern drive scheme that is disclosed in "A new set of high matrix addressing schemes for ferroelectric liquid crystal displays" (Liquid Crystals, 1993, Vo. 13, No. 4,597–601). As shown in FIG. 14, in the J/A drive scheme (J/A in the figure), the selective voltage in the row voltage waveform is selected to have the same width as a time slot T, while in the Malvern-2 and the Malvern-3 drive schemes respectively denoted by (M-2) and (M-3) in the figure, the selective voltages are selected to have widths of 2 times and 3 times of that of the time slot T respectively.

Figure 15:
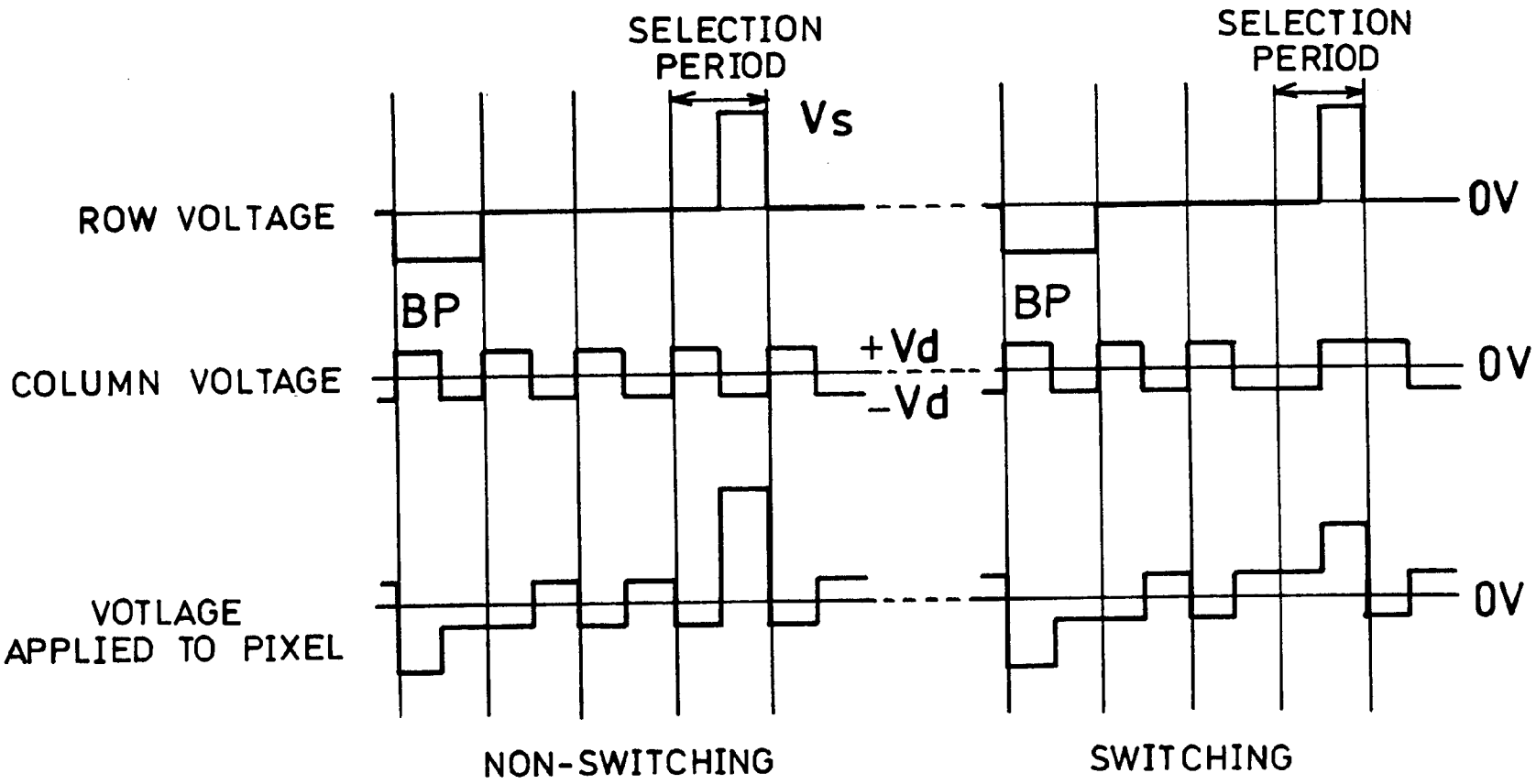
FIG. 15 is a waveform diagram showing respective waveforms of the drive voltage in the non-switching state and the switching state in the blanking drive method applied to the FLCD.

In the case of the FLCD as an example of the matrix-type liquid display apparatus, in the J/A drive scheme, drive voltages respectively having drive voltages shown in FIGS. 13(*a*) and (*b*) are applied in the scanning of 2 fields required for switching the data of one screen, while in the drive scheme disclosed in "Color Digital Ferroelectric Liquid Crystal Displays For Laptop Applications" in SID'92, as shown in FIG. 15, by adopting a blanking pulse BP, the data in one screen is rewritten only in the second field.

The scanning method to be applied to the FLCD having the described structure will be explained below showing first through sixth scanning methods. It should be understood that each of the below-presented first through sixth scanning methods is also applicable to other matrix-type display apparatuses.

[First Scanning Method]

First, in the FLCD having m scanning electrodes L, a correlation between the number of gradations R and the number of scanning n in the case of scanning the scanning electrode L n times within one frame period is determined.

In the scanning method, R and n which satisfy the condition of the formula (3) are obtained so as to hold the formula (1).

Figure 24:
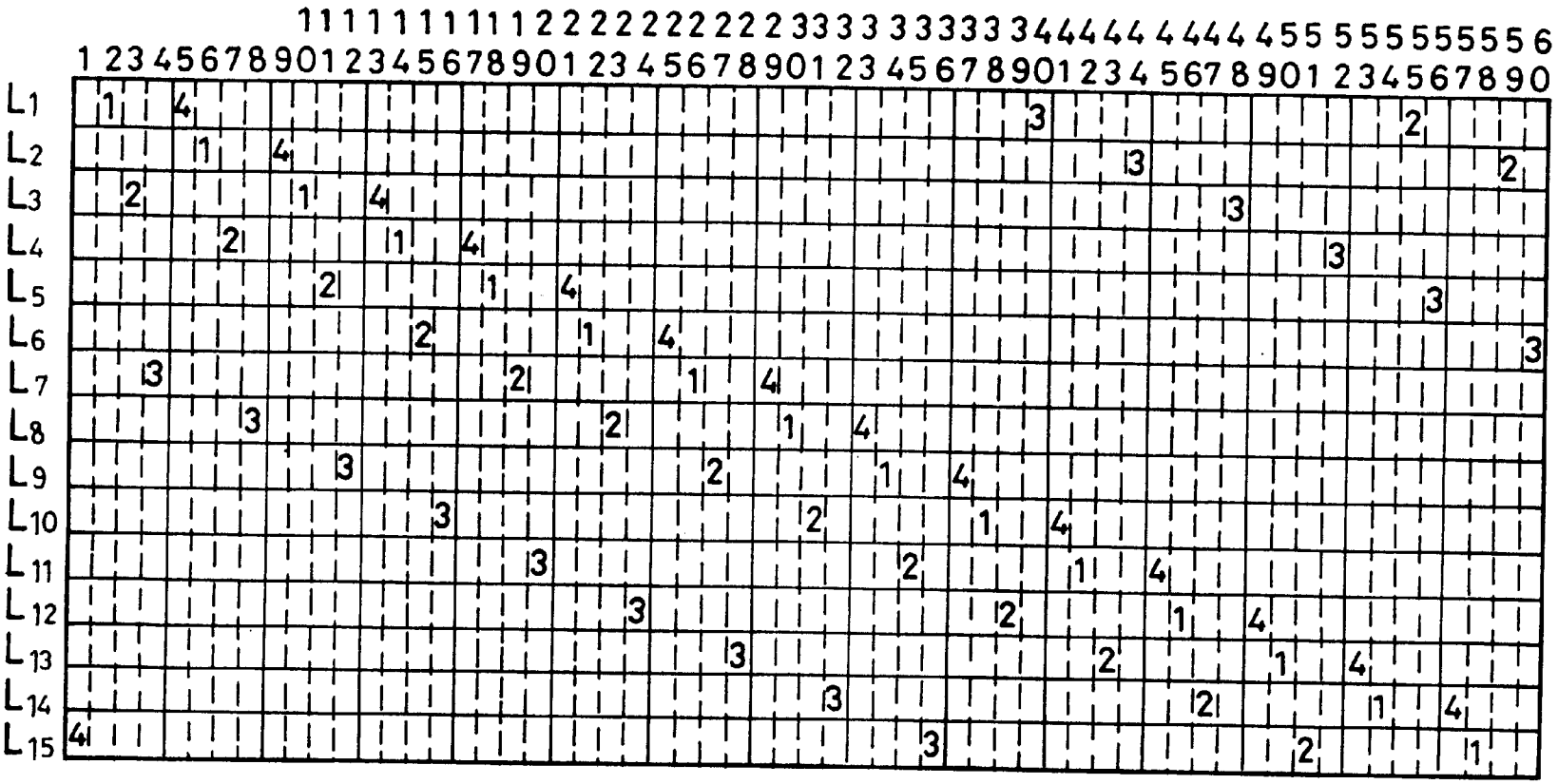
FIG. 24 PRIOR ART
FIG. 24 is an explanatory view showing a scanning pattern in the conventional FLCD.

For example, in the case of the gradation display having the number of gradations R=2, with the time ratio of the respective display periods of 1:2, and the number of scanning n is 2, R=n is given, and the formula (1) does not hold. When the number of scanning n is 3, and time ratio of the display periods is 1:2:4, $(R+R^2)/n=6/3=2$ is given, and the formula (1) does not hold. When the number of scanning n is 4, and time ratio of the display periods is 1:2:4:8, $R^2=n$ is given, and again the formula (1) does not hold. The described scanning method corresponds to the aforementioned conventional scanning method (see FIG. 24).

In the case of the gradation display with the number of gradations R=4, when the conditions of the number of scanning n is 2, and the time ratio is 1:4, R/n=4/2=2 is given, and the formula (1) does not hold. On the other hand, when the number of scanning n is 3, and the time ratio is 1:4:16, R, $R^2$ and $R+R^2$ are 4, 16 and 20 respectively, which satisfy the condition of the formula (3), and neither of R, $R^2$ and $R+R^2$ is a multiple of 3. Thus, if X is not a multiple of 3 in the formula (4), the formula (4) is satisfied.

Here, $$ROT_3(X)=1 \text{ or } 2 \quad \ldots (10),$$

$$ROT_3(5X)=2 \text{ or } 1 \quad \ldots (11),$$

and $$ROT_3(21X)=0 \quad \ldots (12)$$

are given, and the formula (1) holds.

Under the described condition, by substituting 4 for R and 3 for n in the formula (2), $$(1+4+16)X=21X=3(m+b) \quad \ldots (13)$$

is given which is rearranged to X=(m+b)/7. Thus, if m+b is a multiple of 7, all the conditions are satisfied, such as with X=1, m+b=7, and with X=2, m+b=14, etc.

Then, when X is set in the described manner, respective data assigned to the 1st, 2nd, . . . the nth display period are displayed in respective ath, (X+a)th, . . . , the $[(1+R+\ldots+R^{n-2})X+a]$th selection periods.

Figure 1:
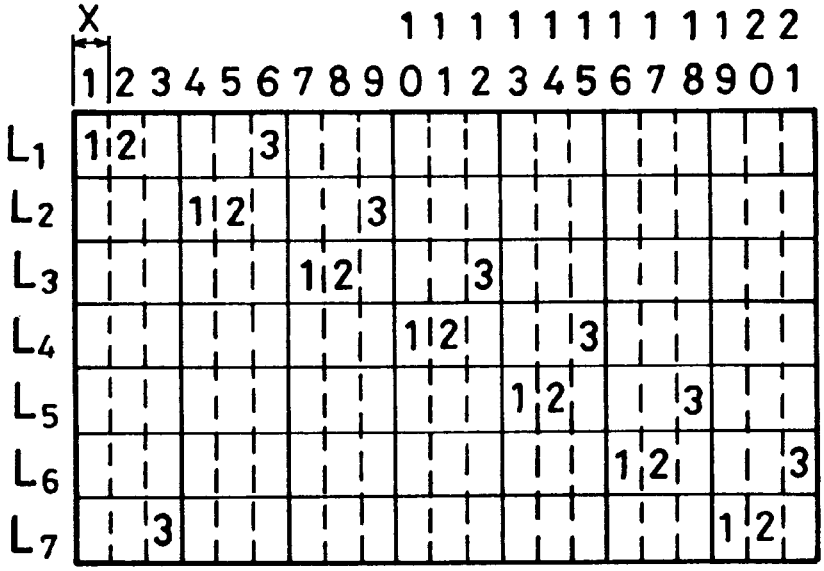
FIG. 1 is an explanatory view showing a scanning pattern in accordance with the first scanning method of an FLCD in accordance with one embodiment of the present invention.

FIG. 1 shows the scanning method with m=7 (b=0) in a pattern.

In the scanning pattern shown in FIG. 1, the 1st through 21st selection periods are formed, and the order of scanning the scanning electrodes $L_1$ through $L_7$ are indicated by numbers "1" through "3". In this scanning pattern, as X=1, a display is performed in each of the scanning electrode $L_1$ through $L_7$ in respective selection periods of the ath, the (1+a)th, . . . , the (5+a)th selection periods. For example, in the scanning electrode $L_1$, with a=1, a display is performed in the 1st, 2nd, and the 6th selection periods. On the other hand, in the scanning electrode $L_2$, with n=4, a display is performed in the 4th, 5th and the 9th scanning periods.

As described, according to the scanning method, a gradation display with a time ratio of 1:4:16 can be performed accurately.

In the above example, explanations have been given through the scanning method of the FLCD having 7 scanning electrodes S. However, by replacing the scanning electrode $L_i$ in FIG. 1 by scanning electrodes $L_{20i}$ through $L_{20i+19}$, the same gradation display can be achieved also for the FLCD having 140 scanning electrodes L. It should be also understood that the number of scanning electrodes, the number of scanning and the time ratio are not limited to those adopted in the described preferred example.

[Second Scanning Method]

In this scanning method, a blanking period is formed, and a scanning operation is performed based on the correlation defined by the aforementioned formula (5).

If the condition of the formula (7) is satisfied, the correlation defined by the formula (5) holds. For example, in the case of gradation display under the conditions of R=2, n=2, and the time ratio of the display periods of 1:2, the formula (7) is given as:

$$ROT_2(X+Y)=ROT_2(2X+Y)\neq 0 \quad \ldots (14).$$

This correlation holds when $$q2=(2-1)X=X \quad \ldots (15)$$

from the formula (8). In this case, with X=0, a display cannot be performed. Thus, a positive integer α is substituted for q which rearrange the formula (15) as:

$$X=2\alpha \quad \ldots (16).$$

From the formula (9), to set the least common multiple M of X+Y and 2 equal to 2(X+Y), X+Y must be an odd number. Thus, 0 or a positive integer β is assigned, which gives $$X+Y=2\beta+1 \quad \ldots (17).$$

This gives the formula (6) as:

$$(1+2)X+2Y = X+2(X+Y) \quad (18)$$

$$= 2\alpha + 2(2\beta + !) = 2(m+b),$$

wherein (2β+1) may be various values such as 5, 7, 11, etc.

For example, when $$X+Y=2\beta+1=5 \quad \ldots (19),$$

formula (18) becomes:

$$\alpha+2\beta+1=\alpha+5=m+b \quad \ldots (20)$$

$$\alpha=m+b-5 \quad \ldots (21)$$

By specifying α in the described manner, the correlation between m and X can be defined.

Namely, if the condition of m+b=k+5 (k is a positive integer) is satisfied, α is determined to be a positive integer.

For example, with given b=0, m=7 when k=2 and, and α=2 is given by the formula (21).

Then, by setting X in the described manner, respective data assigned to the 1st, 2nd, . . . the nth display periods are displayed in respective the ath, (X+Y+a)th, . . . , the $[(1+R+\ldots+R^{n-2})X+(n-1)Y+a]$th selection periods.

Figure 2:
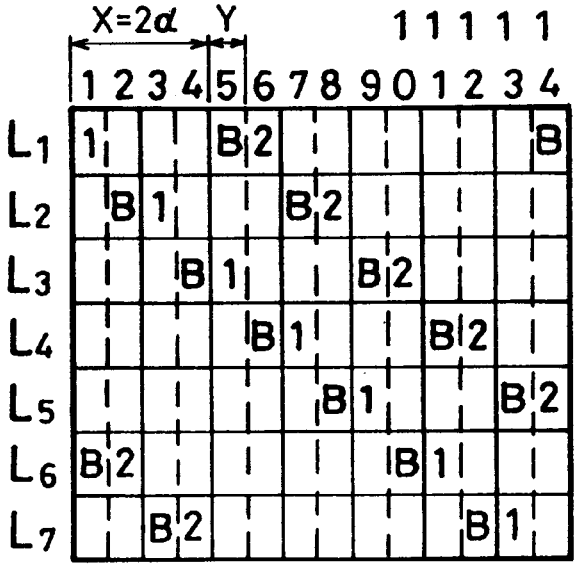
FIG. 2 is an explanatory view showing a scanning pattern in accordance with the second scanning method of the FLCD in accordance with one embodiment of the present invention.

FIG. 2 shows The scanning method with m=7 (b=0) is explained in a pattern.

In the scanning pattern shown in FIG. 2, the 1st through 14th selection periods are formed as n×m is the number of scanning in one frame period. Further, the order of scanning the scanning electrodes $L_1$ through $L_7$ in selection periods are indicated as numbers "1" and "2". In this scanning pattern, X is obtained from the formula (16) with given is obtained from the formula (19), as X=4 and Y=1 are obtained respectively from the formula (16) with α=2, and the formula (19), the scanning pattern indicates a display is performed in each scanning electrode $L_1$ through $L_7$ in the ath and the 5+ath selection periods in each of the scanning electrodes $L_1$ through $L_7$. For example, in the scanning electrode $L_1$, with a=1, a display is performed in the 1st and the 6th selection periods. On the other hand, in the scanning electrode $L_2$, with a=3, a display is performed in the 3rd and 8th scanning periods.

In the described scanning pattern, a start timing of the blanking period is shown by B in a selection period directly before each selection period in which a display is performed. Therefore, the blanking period starts in the selection period, and an erase voltage is applied to the scanning electrode $L_i$ until the blanking period ends.

As described, according to the described scanning method, the gradation display with the time ratio of the display periods of 1:2 can be performed accurately. The scanning method also permits a blanking period to have a uniform length. Thus, by setting the blanking period shorter, the period which is not subject to a display can be significantly reduced.

[Third Scanning Method]

In the third scanning method, a blanking period is formed as in the case of the second scanning method.

In this scanning method, R=2 and n=3, and a gradation display is performed with a time ratio of display periods of 1:2:4.

In this case, the formula (7) is given as:

$$ROT_3(X+Y)=ROT_3(2X+Y)=ROT_3(4X+Y)\neq 0 \quad \ldots (22)$$

This correlation holds when $$q3=(2-1)X=X \quad \ldots (23).$$

In this case, with X=0, a display cannot be performed. Thus, a positive integer α is substituted for q which gives $$X=3\alpha \quad \ldots (24).$$

From the formula (9), to set the least common multiple M of X+Y and 3 equal to 3(X+Y), X+Y cannot be a multiple of 3. Thus, by substituting 0 or a positive integer $$\beta(\beta \geqq 0),$$

$$X+Y=3\beta+1$$

or $$3\beta+2 \quad \ldots (25)$$

is given.

With given X+Y=3β+1, the formula (6) is given as:

$$(1+2+4)X+3Y=4X+3(X+Y) \quad (26)$$

$$=4(3\alpha)+3(3\beta+1)=3(m+b)$$

Here, 3β+1 may take various values such as 4, 7, and 10, and for example, when $$X+Y=3\beta+1=4 \quad \ldots (27),$$

the formula (26) is given as $$4\alpha+3\beta+1=4\alpha+4=m+b \quad \ldots (28)$$

$$\alpha=(m+b-4)/4 \quad \ldots (29).$$

By specifying α in the described manner, the correlation between m and X can be determined.

Namely, under the condition of m+b=4k+4 (k is a positive integer), α is a positive integer.

For example, with given b=0, m=8 when k=1, which gives α=1 from the formula (28).

Figure 3:
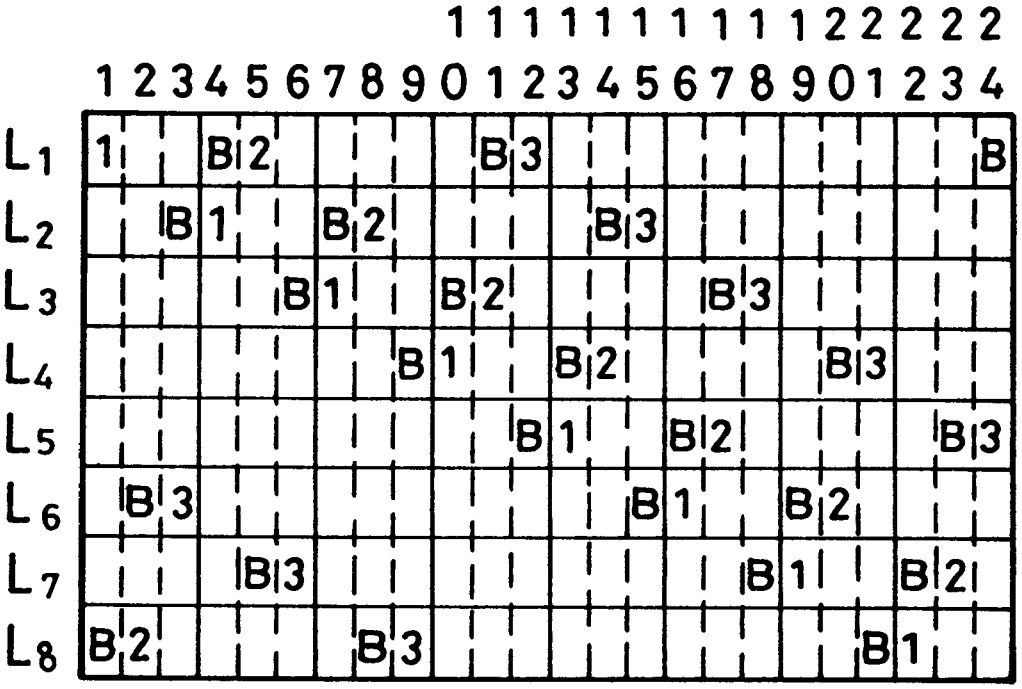
FIG. 3 is an explanatory view showing a scanning pattern in accordance with the third scanning method of the FLCD in accordance with one embodiment of the present invention.

The scanning method with m=8 (b=0) is shown in reference to a pattern of FIG. 3.

In the scanning pattern shown in FIG. 3, the number of scanning in one frame period is n×m, and n=3, and m=8 are given. Thus, the 1st through 24th selection periods are formed, and the order of scanning the scanning electrodes $L_1$ through $L_8$ is indicated as numbers "1" through "3". In this scanning pattern, since X=3 and Y=1 are given respectively from the equation (24) with a given α=1, and Y is given from the formula (27), a display is performed in each of the scanning electrodes $L_1$ through $L_8$ respectively in the ath, the (4+a)th and the (11+a)th selection periods.

In the described scanning pattern, a start timing of the blanking period is shown by B in a selection period directly before each selection period in which a display is performed as in the case of the second scanning method. This can be said also for the below-presented 4th through 6th scanning periods.

As described, in the described scanning method, a gradation display with a time ratio of display periods of 1:2:4 can be performed with accuracy.

[Fourth Scanning Method]

In the fourth scanning method, a blanking period is formed as in the case of the 2nd scanning period.

In this scanning method, R=2 and n=4 are given, and a gradation display is performed with a time ratio of respective display periods of 1:2:4:8.

In this case, the formula (7) is given as:

$$ROT_4(X+Y)=ROT_4(2X+Y)=ROT_4(4X+Y) \quad (30)$$

$$=ROT_4(8X+Y)\neq 0.$$

This correlation holds when $$q4=(2-1)X=X \quad \ldots (31).$$

In this case, with X=0, a display cannot be performed. Thus, a positive integer α is substituted for q which gives:

$$X=4\alpha \quad \ldots (32).$$

From the formula (9), to set the least common multiple M of X+Y and 4 equal to 4(X+Y), X must be a multiple of 4, and X+Y must be an odd number. Thus, 0 or a positive integer β(β≧0) is assigned, and $$X+Y=4\beta+1$$

or $$4\beta+3 \quad \ldots (33)$$

is given.

When X+Y=4β+1, the formula (6) is given as:

$$(1+2+4+8)X+4Y=11X+4(X+Y) \quad (34)$$

$$=11(4\alpha)+4(4\beta+1)=4(m+b).$$

Here, 4β+1 may take various values such as 5, 9, 13, etc., and for example, when $$X+Y=4\beta+1=5 \quad \ldots (35),$$

the formula (34) is given as:

$$11\alpha+4\beta+1=11\alpha+5=m+b \quad (36)$$

$$\alpha=(m+b-5)/11. \quad (37)$$

By specifying α in the described manner, the correlation between m and X can be determined in the described manner.

Namely, under the condition of m+b=11k+5 (k is a positive integer), α is determined to be a positive integer.

For example, with given b=0, m=16 when k=1 and, and α=1 is given from formula (36).

Figure 4:
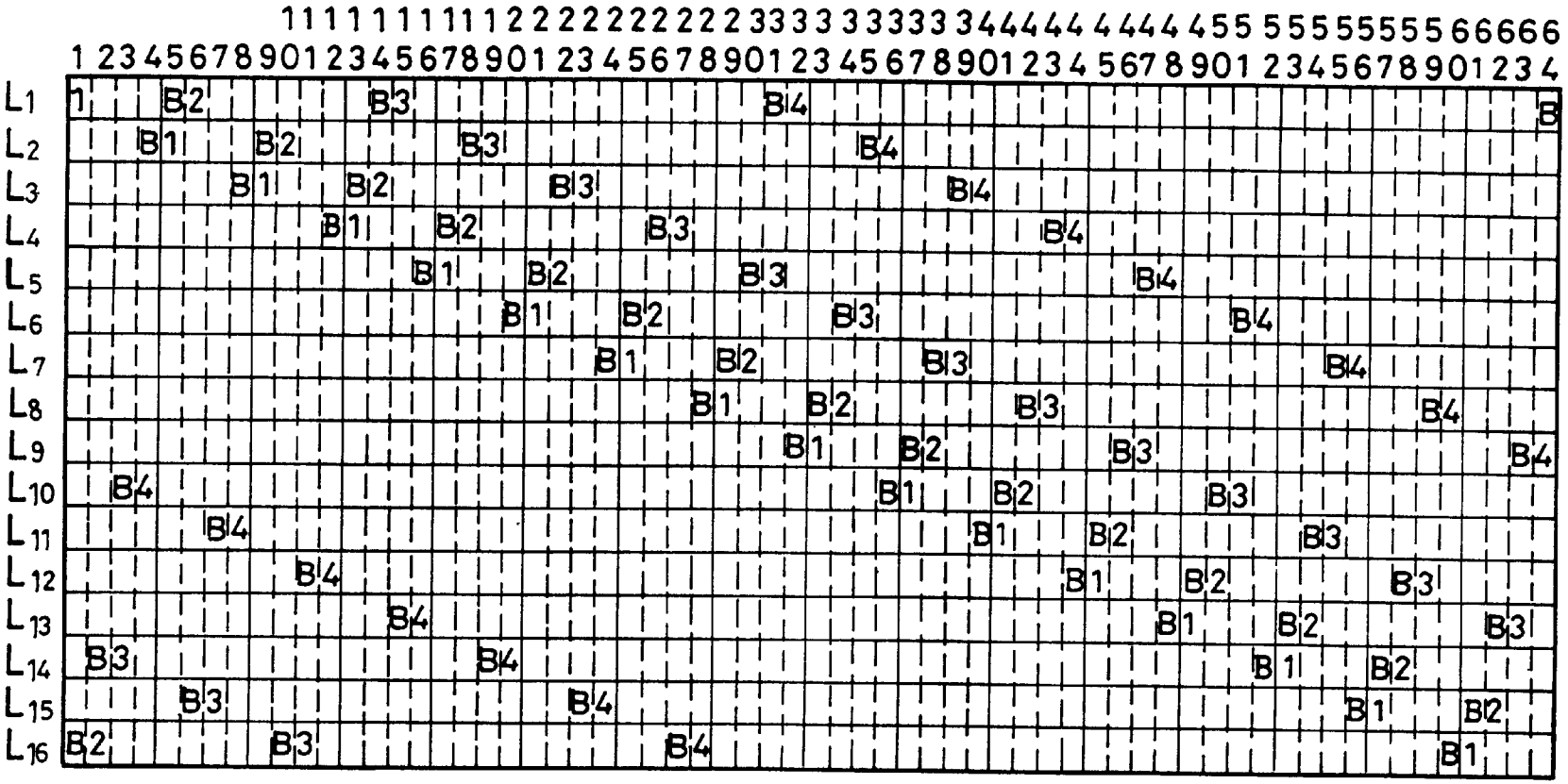
FIG. 4 is an explanatory view showing a scanning pattern in accordance with the fourth scanning method of the FLCD in accordance with one embodiment of the present invention.

The scanning method with m=16 (b=0) is shown in reference to a pattern shown in FIG. 4.

In the scanning pattern shown in FIG. 4, the number of scanning in one frame period is n×m, and n=4 and m=16 are given. Therefore, the 1st through 64th selection periods are formed, and the order of scanning the scanning electrodes $L_1$ through $L_{16}$ in selection periods are indicated as numbers "1" through "4". In this scanning pattern, as X=4 and Y=1 are given respectively from the formula (32) with α=1, and from the formula (35), the scanning pattern indicates that a display is performed in each of the scanning electrodes $L_1$ through $L_{16}$ respectively in the ath, the (5+a)th and the (14+a)th selection periods.

As described, in the described scanning method, a gradation display with a time ratio of 1:2:4:8 can be performed with accuracy.

[Fifth Scanning Method]

In the fifth scanning method, a blanking period is formed as in the case of the second scanning method.

In this scanning method, R=4 and n=2 are given, and a gradation display is performed with a time ratio of display periods of 1:4.

In this case, the formula (7) is given as $$ROT_2(X+Y)=ROT_2(4X+Y)\neq 0 \quad \ldots (38).$$

This correlation holds when $$q2=(4-1)X=3X \quad \ldots (39).$$

In this case, if X=0, a display cannot be performed. Thus, a positive integer α is substituted for q, which gives:

$$X=2\alpha/3 \quad \ldots (40)$$

From the formula (9), to set the least common multiple M of X+Y and 2 be equal to 2(X+Y), X must be an odd number. Thus, a positive integer β(β≧0) is assigned, which gives:

$$X+Y=2\beta+1 \text{ is given} \quad \ldots (41).$$

In this case, the formula (6) becomes:

$$(1+4)X+2Y=3X+2(X+Y) \quad (42)$$

$$=3(2\alpha/3)+2(2\beta+1)=2(m+b).$$

Here, 2β+1 may take various values such as 3, 5 and 7, etc., for example, $$X+Y=2\beta+1=3 \quad \ldots (43).$$

Then, the formula (42) is given as:

$$\alpha+2\beta+1=\alpha+3=m+b \quad \ldots (44)$$

$$\alpha=(m+b-3) \quad \ldots (45).$$

By specifying α in the described manner, the correlation between m and X is determined.

Namely, under the condition of m+b=k+3 (k is a positive integer), α is a positive integer.

For example, with given b=0, m=6 when k=3, and α=3 is given from the formula (45).

Figure 5:
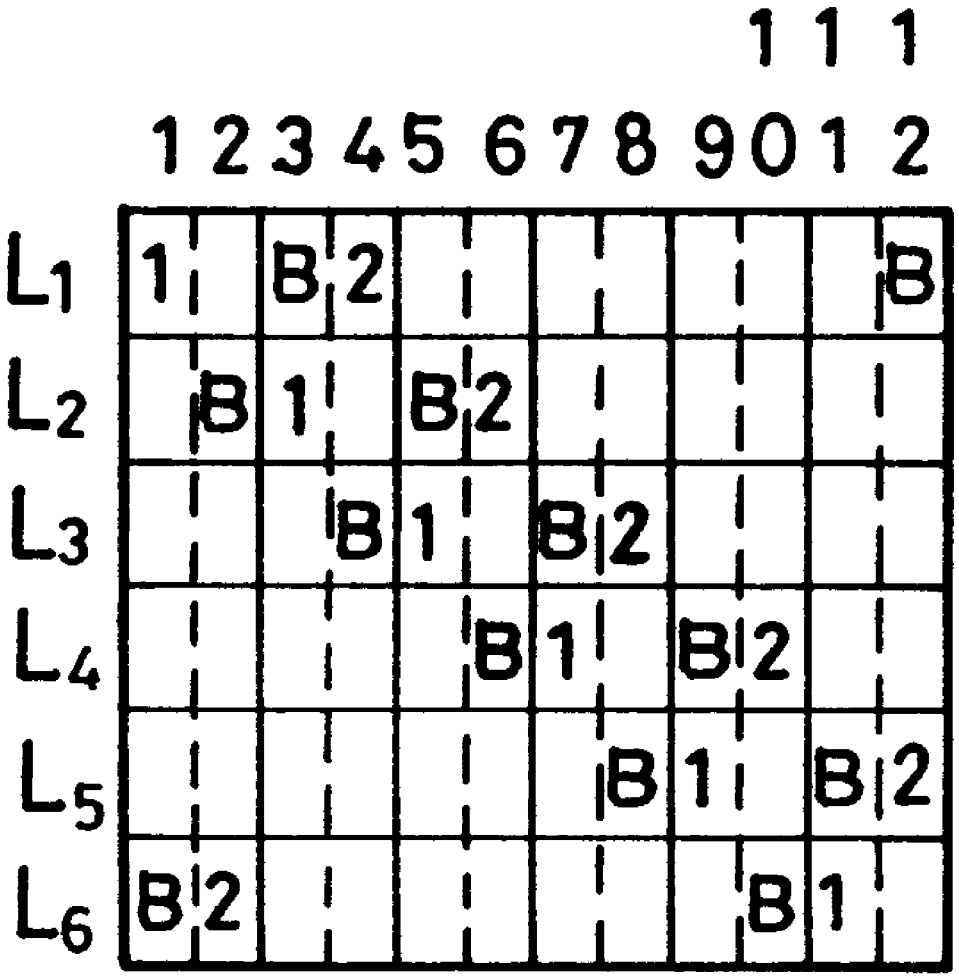
FIG. 5 is an explanatory view showing a scanning pattern in accordance the fifth scanning method of the FLCD in accordance with one embodiment of the present invention.

FIG. 5 shows a scanning method with m=6 (b=0) in reference to a pattern.

In the scanning pattern shown in FIG. 5, n×m is the number of scanning in one frame period, and n=2, and m=6 are given, and thus the 1st through 12th selection periods are formed, and the order of scanning the scanning electrodes $L_1$ through $L_6$ are indicated as numbers "1" and "2". In this scanning pattern, as X=2 and Y=1 are given respectively from the formula (40) with α=3, and the formula (43), the scanning pattern indicates that a display is performed in each of the scanning electrodes $L_1$ through $L_6$ in the ath and the (3+a)th selection periods respectively.

As described, in the described scanning method, a gradation display with a time ratio of the display periods of 1:4 can be performed with accuracy.

[Sixth Scanning Method]

In the sixth scanning method, a blanking period is formed as in the case of the second scanning method.

In this scanning method, R=4 and n=3 are given, and a gradation display is performed with a time ratio of respective display periods of 1:4:16.

In this case, the formula (7) is given as:

$$ROT_3(X+Y)=ROT_3(4X+Y)=ROT_3(16X+Y)\neq 0 \quad \ldots (46).$$

This correlation holds when $$q3=(4-1)X=3X \quad \ldots (47).$$

In this case, if X=0, a display cannot be performed, and thus a positive integer α is substituted for q, $$X=\alpha \quad \ldots (48)$$

is given.

From the formula (9), to set the least common multiple M of X+Y and 3 be equal to 3(X+Y), X+Y cannot be a multiple of 3. Thus, 0 or a positive integer β is assigned, $$X+Y=3\beta+1$$

or $$3\beta+2 \quad \ldots (49)$$

is given.

When X+Y=3β+1, the formula (6) is given as:

$$(1+4+16)X+3Y=18X+3(X+Y) \quad (50)$$

$$=18\alpha+3(3\beta+1)=3(m+b).$$

Here, 3β+1 may take various values such as 4, 7, 10, etc., and in order to apply the described scanning method to the FLCD, if $$X+Y=3\beta+1=7 \quad \ldots (51)$$

is given, $$6\alpha+3\beta+1=6\alpha+7=m+b \quad \ldots (52)$$

$$\alpha=(m+b-7)/6 \quad \ldots (53)$$

from the formula (50).

By specifying α in the described manner, the correlation between m and X can be determined.

Namely, under the condition of m+b=6k+7 (k is a positive integer), α is determined to be a positive integer.

For example, with given b=0, when k=2, m=19, and α=2 is given from the formula (53).

Figure 6:
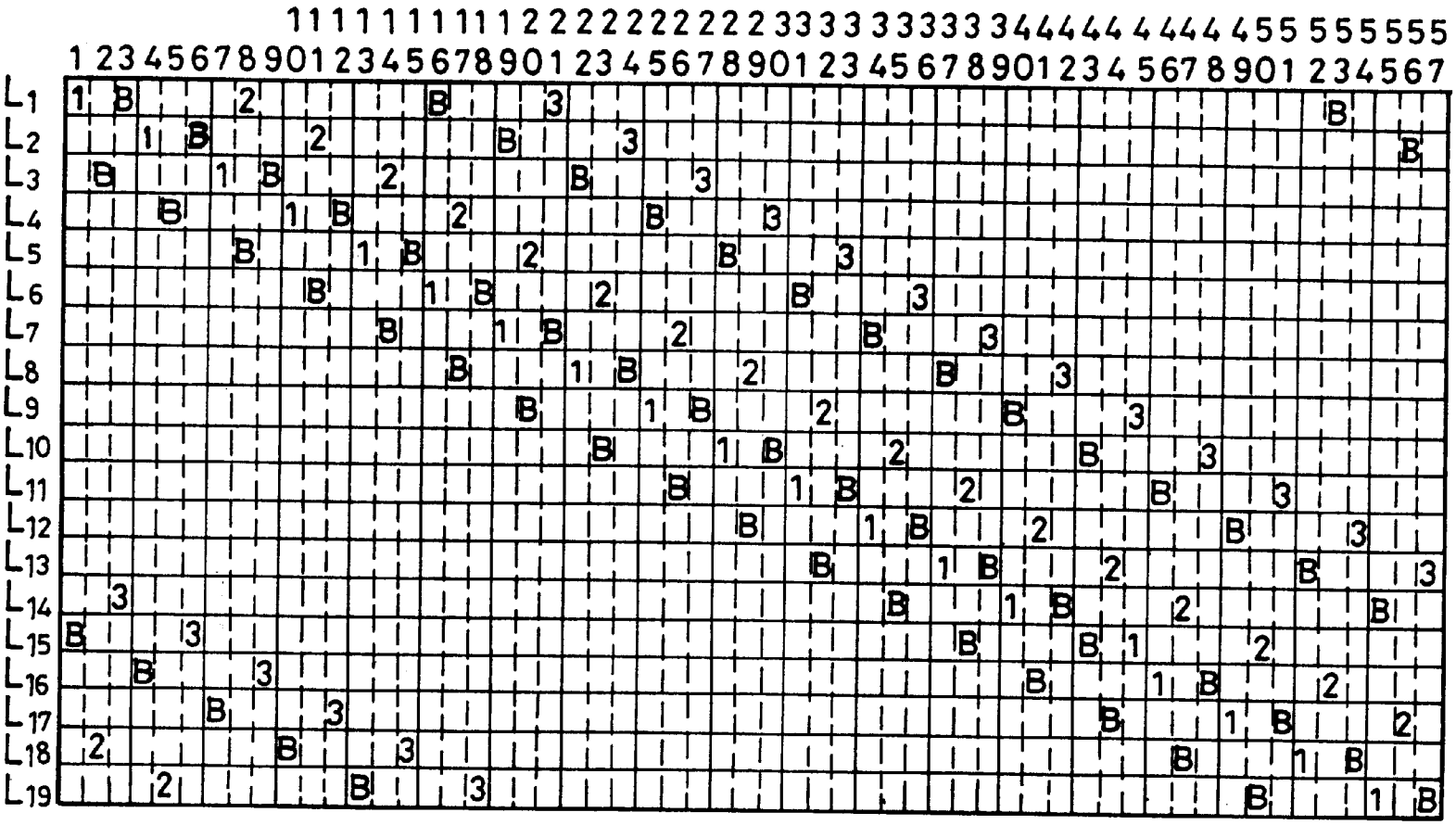
FIG. 6 is an explanatory view showing a scanning pattern in accordance the sixth scanning method of the FLCD in accordance with one embodiment of the present invention.

The scanning method with m=19 (b=0) in reference to a pattern of FIG. 6.

In the scanning pattern shown in FIG. 6, the number of scanning in one frame period is n×m, and n=3, m=19 are given. Therefore, the 1st through 57th selection periods are formed, and the order in selection periods of scanning in the scanning electrodes $L_1$ through $L_{19}$ is defined as numbers "1" through "3". In this scanning pattern, as X=2 and Y=5 are given respectively from the formula (48) with α=2, and the formula (51), and thus the scanning pattern indicates that a display is performed in each of the scanning electrodes $L_1$ through $L_{19}$ in the ath, the (7+a)th, the (20+a)th s election periods respectively.

As described, in the described scanning method, a gradation display with a time ratio of 1:4:16 can be performed with accuracy.

Figure 7:
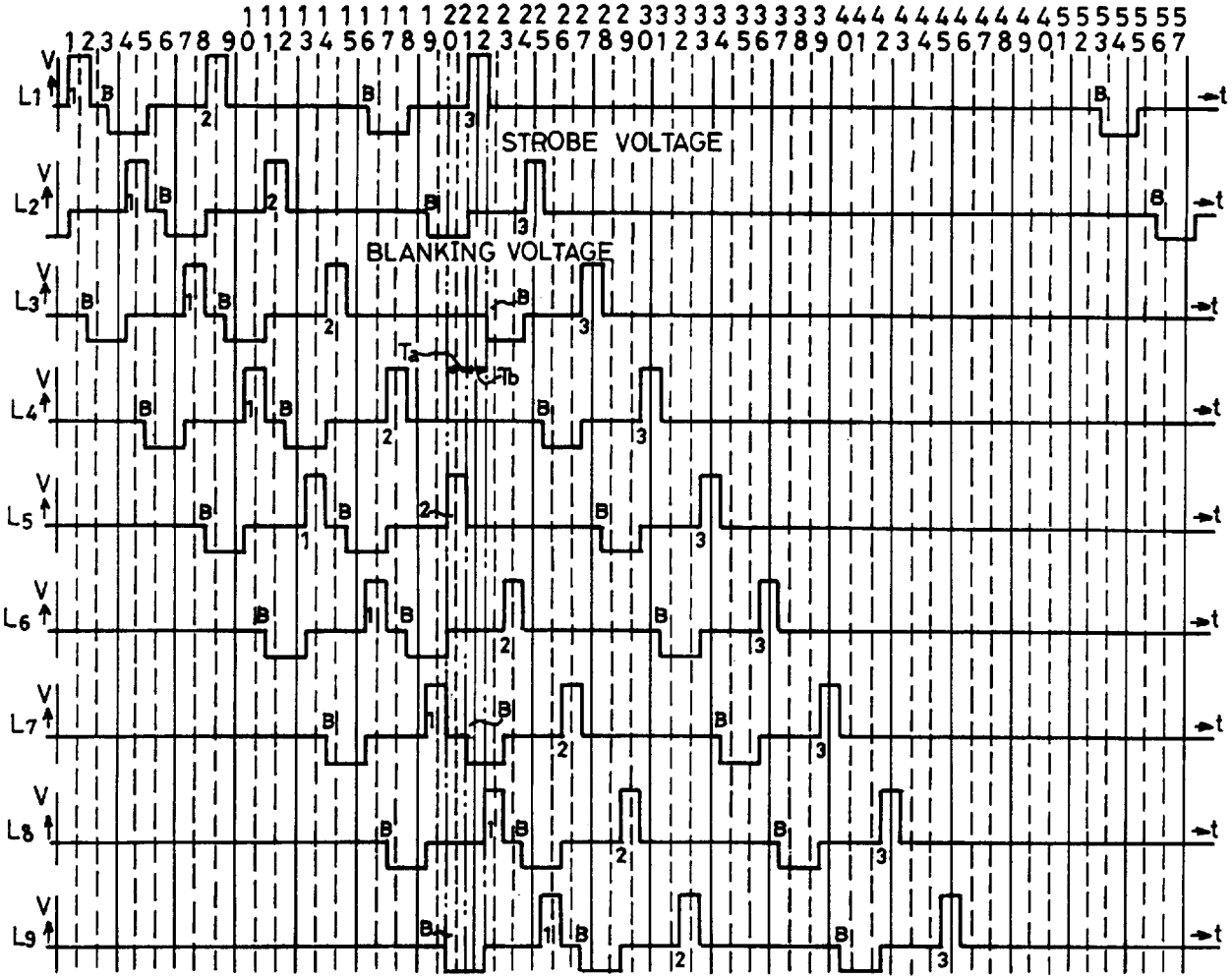
FIG. 7 is a waveform diagram showing a waveform of a voltage to be applied to each scanning electrode when adopting the sixth scanning method.

FIG. 7 is a waveform diagram of the voltage to be applied to the scanning electrodes $L_1$ through $L_9$ in the sixth scanning method of the FLCD to which the driving method using a blanking pulse (see FIG. 15) is applied to the Malvern drive scheme (FIG. 14). In FIG. 7, the x-axis indicates time t, and the number of selection period as in FIG. 6, while the y-axis indicates voltage V. In FIG. 7, the strobe voltage corresponds to the selection voltage, and the blanking voltage corresponds to the erase voltage.

In order to permit the described voltages to be applied to the scanning electrodes L, a slight modification of the FLCD shown in FIG. 9 is needed.

Figure 16:
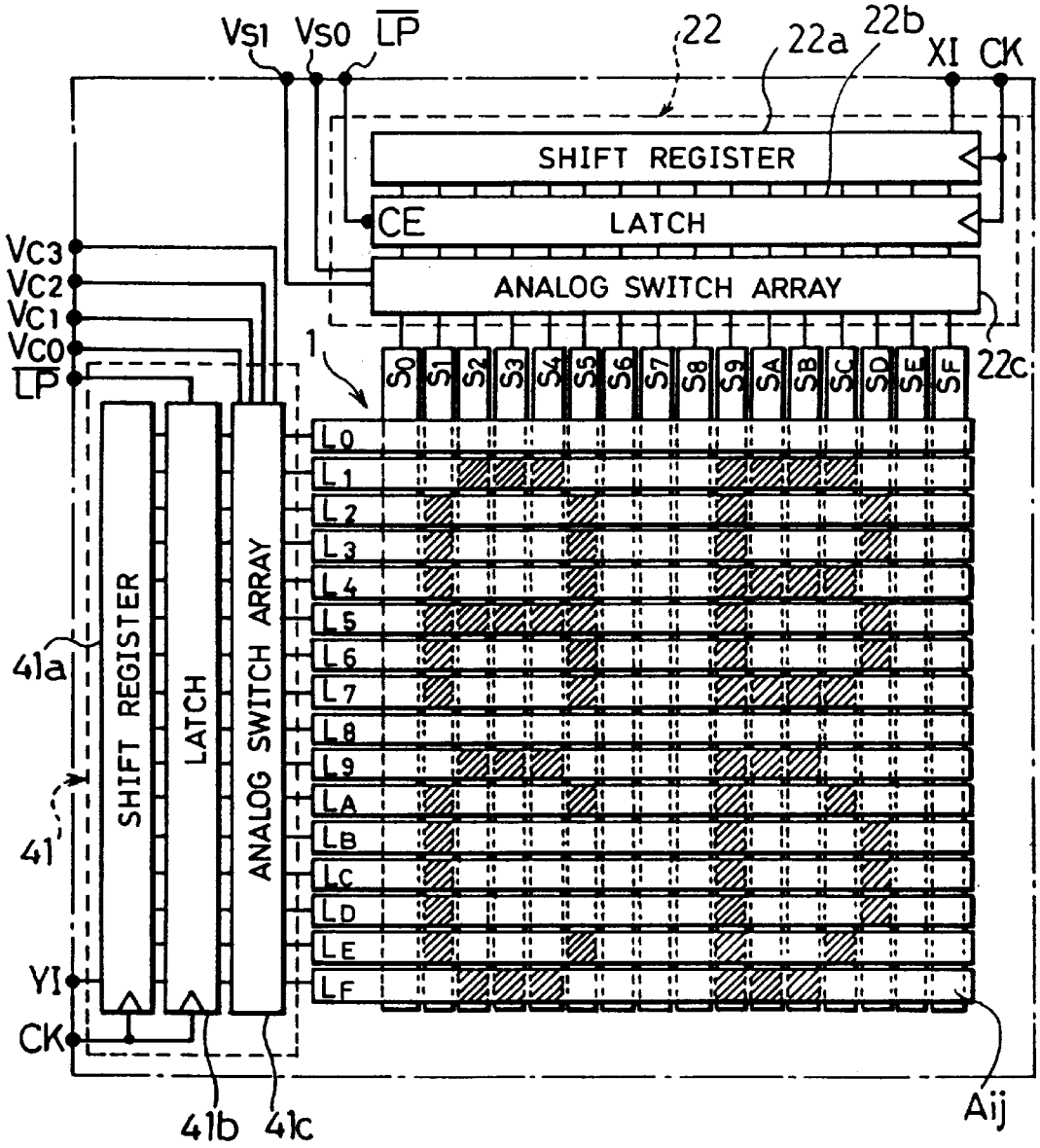
FIG. 16 is a plan view showing the structure of essential parts of the FLCD to which the sixth scanning method is suitably applied.

As shown in FIG. 16, the FLCD suited for the 6th scanning method includes a scanning electrode driving circuit 41. The scanning electrode driving circuit 41 includes shift register 41*a* for 2-bit, a latch 41*b* which is the same as the latch 21*b*, and an analog switch array 41*c* capable of inputting four voltages.

In the scanning electrode driving circuit 41, a 2-bit scanning signal YI is transferred by the shift register 41*a* based on a clock CK. When the latch pulse LP of the negative logic becomes significant in the middle of each selection period, the data in the shift register 41*a* is held in the latch 41*b*.

The analog switch array 41*c* outputs different voltages depending on which of the data "0" through "3" is stored in the latch 41*b*. When the data "0" is stored, a non-selective voltage $V_{c0}$ is outputted. On the other hand, when the data "1" is stored, the selective voltage $V_{c1}$ is outputted. When the data "2" is stored, an extended selection voltage $V_{c2}$ is outputted. When the data "3" is stored, the erase voltage $V_{c3}$ is outputted. These voltages are applied to the scanning electrode $L_i$ connected to signal lines from which respective values are outputted.

In the FLCD, for example, when the latch pulse LP becomes significant in the middle of the 20th selection period, the scanning signal YI is inputted so that the data is assigned to the output terminal of the shift register 41*a* assigned to a specific scanning electrode $L_i$. Here, the data "1", the data "3", and the data "0" are respectively related to the scanning electrode $L_5$, the scanning electrodes $L_2$ and $L_9$, and other scanning electrodes L. As a result, in the period $T_a$ over the 20th and 21st selection periods, the selection voltage $V_{c1}$ is applied to the scanning electrode $L_5$, and the erase voltage $V_{c3}$ is applied to the scanning electrodes $L_2$ and $L_9$.

When the latch pulse LP becomes significant in the middle of the 21st selection period, the data "1", the data "3" and the data "0" are respectively related to the scanning electrode $L_1$, the scanning electrode $L_7$ and $L_9$ and the other scanning electrodes L. As a result, in the period $T_b$ over the 21st and 22nd selection periods, a selection voltage $V_{c1}$ is applied to the scanning electrode $L_1$, and an erase voltage $V_{c3}$ is applied to the scanning electrode $L_7$ and $L_9$.

As can be seen from FIG. 7, in the FLCD, the selection voltage (strobe voltage) and an erase voltage (blanking voltage) have certain latitudes. Thus, it is unclear when the display period starts: at a start of an application of the strobe voltage, during the application of the strobe voltage, or upon completion of the application of the strobe voltage. It is also unclear when the display period starts: at a start of an application of a blanking voltage, during the application of the blanking voltage, or upon completion of the blanking voltage.

In such situations, by shifting back or forth the application timing of the blanking voltage, the ratio of the display time can be adjusted.

[Memory Device for Gradation Display]

The below-discussed memory device is a circuit for storing data which permits such gradation display that scanning electrodes L are scanned 4 times in one frame period with time ratio of respective display periods (1st, 2nd, 3rd and 4th)=X:2X:4X:8X. The memory device of the present embodiment is applicable to the FLCD that enables the described first and second scanning methods and to any time-division gradation display method including conventional methods.

Figure 17:
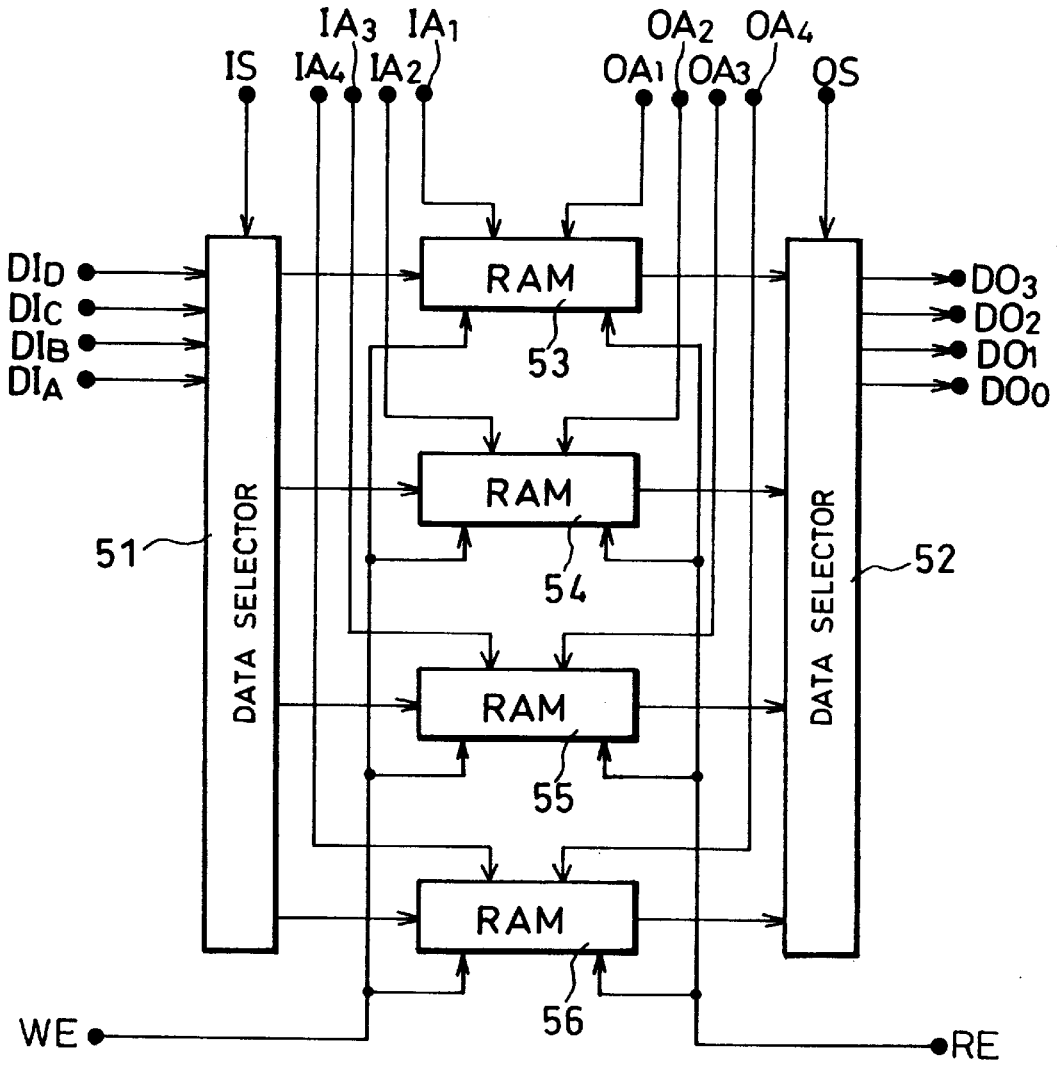
FIG. 17 is a block diagram showing a structure of a memory device which outputs data in an array suited for use in the scanning method for a time division gradation display in the matrix-type display apparatus in accordance with one embodiment of the present invention.

As shown in FIG. 17, the memory device of the present embodiment includes data selectors 51 and 52 and RAMs 53 through 56.

The data selector 51 has four input terminals and four output terminals. The data selector 51 allocates four input data $DI_A$, $DI_B$, $DI_C$ and $DI_D$ into the RAMs 53 through 56 (memory blocks) by a select signal IS to be outputted. The input data $DI_A$, $DI_B$, $DI_C$ and $DI_D$ assigned respectively to the 1st through 4th bits, and the last bit of each data is selected from A through D as shown in FIG. 18.

For example, "000A" indicates data of the 1st bit to be applied to the 1st pixel of the scanning electrode $L_1$, and "003D" indicates data of the 4th bit to be applied to the 4th pixel of the scanning electrode $L_1$. "011B" indicates the data of the 2nd bit to be applied to the 2nd pixel of the scanning electrode $L_2$, and "013C" indicates the data of the 3rd bit to be applied to the 4th pixel of the scanning electrode $L_2$.

To the RAMs 53 through 56, input addresses $IA_1$ through $IA_4$ and the output addresses $OA_1$ through $OA_4$ are respectively given. The 1st, 2nd and 4th digits of the input addresses $IA_1$ through $IA_4$ and the output addresses $OA_1$ through $OA_4$ have the following correspondence (see FIG. 18 and FIG. 19).

The 1st digit of the data of the 1st through 4th pixels is "0", and the 1st digit of the data of the 5th through 8th pixels is "1". The respective 2nd digits of the scanning electrode $L_1$ through $L_{16}$ are "0" through "F" respectively. The 4th digits of the 1st through 4th bits are respectively "0" through "3". In the RAMs 53 through 56, whether or not writing is permitted is determined by a write-enable signal WE, and whether or not reading is permitted is determined by a read-enable signal RE.

The data selector 52 has four input terminals and four output terminals. The data selector 52 outputs data from the RAMs 53 through 56 for each pixel. Specifically, the data of the first and the fifth pixels are outputted as the output data $DO_0$, and the data of the second and the sixth pixel are outputted as the output data $DO_1$. The data of the third through seventh pixels are outputted as the output data $DO_2$, and the data of the 4th and the 8th pixels are outputted as the output data $DO_3$.

In the described arrangement, four input data $DI_A$, $DI_B$, $DI_C$ and $DI_D$ are allocated into the RAMs 53 through 56 by the data selector 51, and are written as the input addresses $IA_1$, $IA_2$, $IA_3$ and $IA_4$ as shown in FIG. 18 in the RAMs 53 through 56. The input data $DI_A$ assigned to the 1st display period is written in the RAMs 53, 54, 55 and 56 in this order. The input data $DI_B$ assigned to the 2nd display period is written in the RAMs 54, 55, 56 and 53 in this order. The input data $DI_C$ assigned to the 3rd display period is written in the RAMs 55, 56, 53 and 54 in this order. The input data DID assigned to the 4th display period is written in the RAMs 56, 53, 54 and 55 in this order.

For input addresses $IA_1$, $IA_2$, $IA_3$ and $IA_4$, 8 addresses are prepared for the data of the 1st through 8th pixels to be applied to the scanning electrodes $L_1$, $L_2$ . . . respectively. For the data of the 1st through 4th pixels, the same address is allocated, while for the data of the 5th and 8th pixels, the same address that is different from those of the data of the 1st through 4th pixels is assigned.

Next, as shown in FIG. 19, when output addresses $OA_1$, $OA_2$, $OA_3$ and $OA_4$ are applied to the RAM 53 through 56, the data is read from the RAMs 53 through 56. Here, for the output addresses $OA_1$, $OA_2$, $OA_3$ and $OA_4$, the same address is given simultaneously. As a result, data are outputted all together by bit in the scanning electrodes $L_1$, $L_2$, . . . from the RAMs 53 through 56. Then, the data from the RAM 53 through 56 are allocated for each pixel by the data selector 52 and are outputted as output data $DO_0$ through $DO_3$ to be a data signal XI as shown in FIG. 9.

As described, by writing data of the 1st through 4th bits assigned respectively to the 1st through 4th display periods in the RAMs 53 through 56, by assigning the same address, when reading the data, the data of bit assigned to the display period are outputted all together. For example, in the case of the output address "0000", the data of the 1st bit assigned to the 1st display period is outputted simultaneously from the RAMs 53 through 56.

Figure 20:
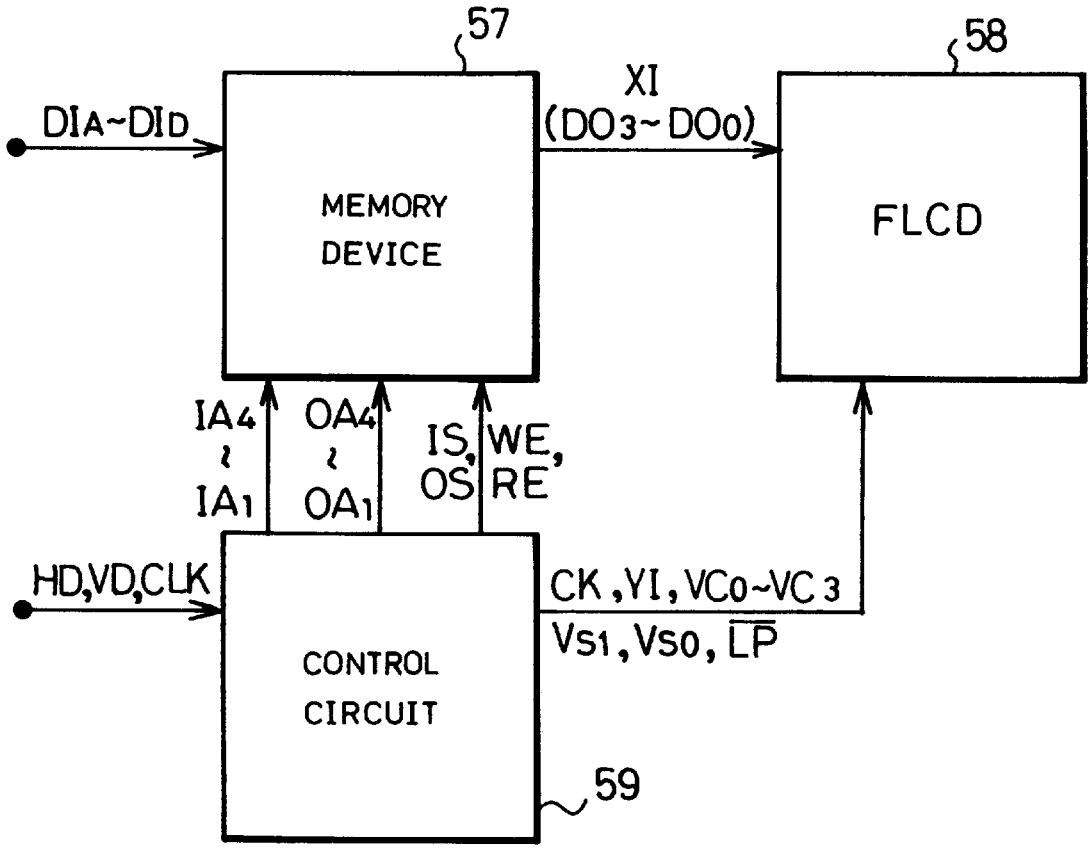
FIG. 20 is a block diagram showing a schematic structure of the matrix-type display apparatus including the memory device of FIG. 17.

In the matrix-type display apparatus having the arrangement shown in FIG. 20, the memory device is provided as a memory device 57. The gradation data outputted from the memory device 57 is inputted as data XI to the FLCD 58 having the structure of FIG. 16. Here, a control signal indicative of an address of the memory device 57, and other control signals required for the FLCD 58 are supplied from the control circuit 59.

As shown in FIG. 18, when we focus the data of the 1st bit, eight addresses are required for one scanning electrode on the input side, while two addresses are required for one scanning electrode on the output side. This can be said for other bits. Therefore, in the matrix-type display apparatus, with a memory effect that permits 2-gradation display, by reading together four 2-gradation data assigned respectively to the 1st through 4th display period bit by bit, a time-division display with a ratio of display periods of X:2X:4X:8X can be performed by scanning the scanning electrodes four times in one frame period.

The explanations have been given through the scanning method in which four scanning operations are performed in one frame period for the scanning electrode L. However, the number of scanning to be performed is not limited to the above.

Additionally, in the described explanations, the 4 memories which permit addresses to be inputted independently, having the most suitable structure for the described scanning method in which the scanning operation is performed four times in one frame period is adopted. However, as long as the possible reduction in efficiency is within the permissible level, for example, as shown in FIG. 21, two paris of RAMs 63 and 64, and RAMs 65 and 66 which permit addresses to be inputted independently may be adopted.

In this case, upon inputting the input address as shown in FIG. 22, the data distributed at the data selector 61 are stored in the RAMs 63 and 64. When the output address is inputted as shown in FIG. 23, the data is read from the RAMs 63 and 64, and are outputted as output data $DO_0$ and $DO_1$ through the data selector 62.

The described arrangement offers the memory device for the time-division gradation display like the aforementioned structure.

Figure 21:
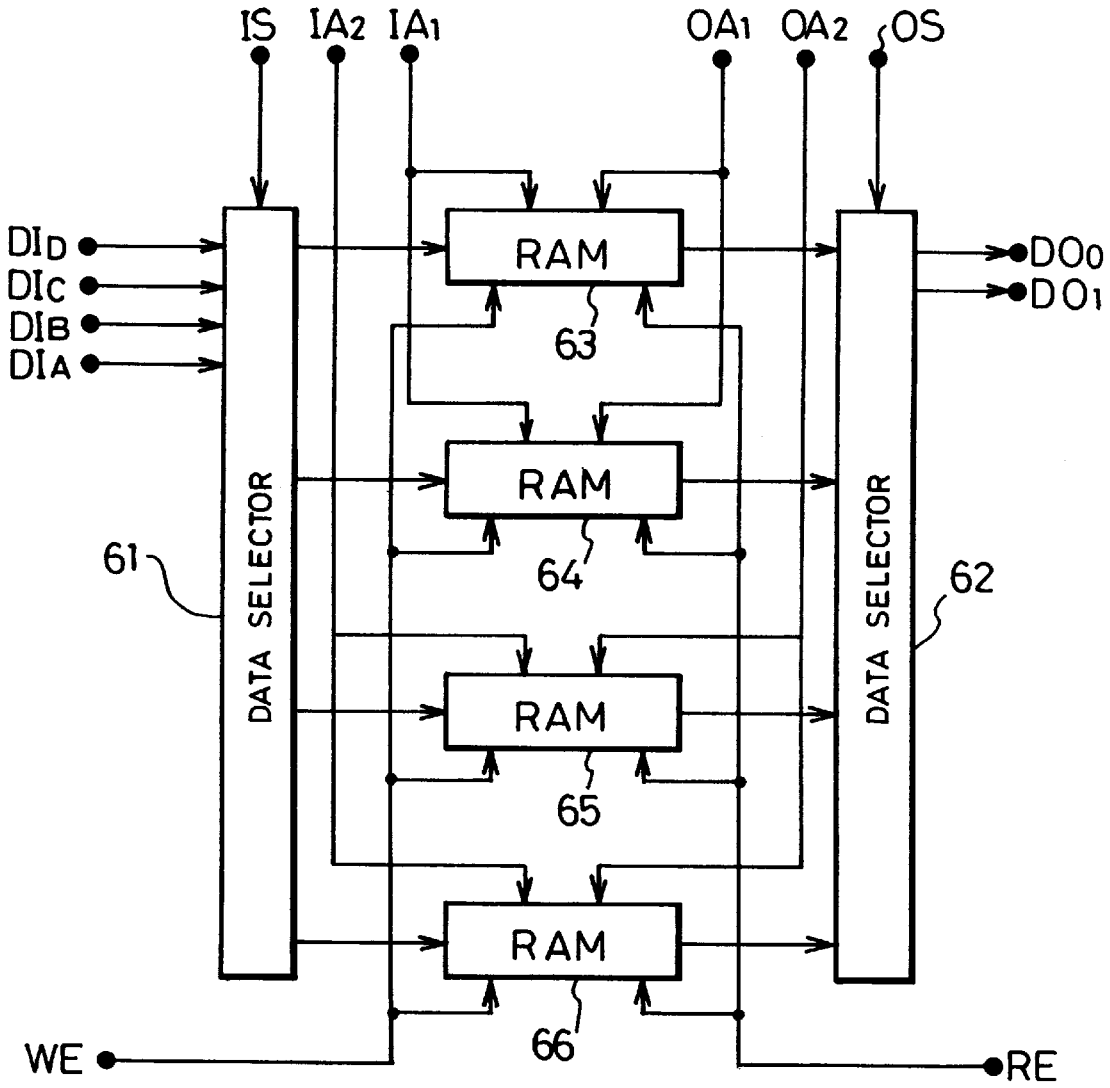
FIG. 21 is a block diagram showing a structure of an alternative memory device of that shown in FIG. 17.

When the output address shown in FIG. 23 is compared with the output address shown in FIG. 19, in the structure of FIG. 21, addresses required for reading the data of one scanning electrode are two times as many as that required in the structure of FIG. 17. However, even in the described structure of FIG. 21, the number of addresses for reading the data in one scanning electrode is one half of that required in the conventional structure.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the instant contribution to the art and, therefore, such adaptations should and are intended to be comprehended within the meaning and range of equivalence of the appended claims.

What is claimed is:

1. A driving method of a matrix-type display apparatus which permits a time-division gradation display, designed for a matrix-type display apparatus having a memory effect which permits a gradation display with a number of gradations R (R is an integer of not less than 2), said matrix-type display apparatus including m scanning electrodes and a plurality of signal electrodes which cross each other, said driving method comprising the steps of:

(i) scanning said m scanning electrodes n times in one frame period under such condition that a time ratio of the 1st, the 2nd, . . . , the nth display periods (n is an integer of not less than 2) is X:RX: . . . :$R^{n-1}$X (X is a positive integer) based on R and n which satisfy $$ROT_n(X) \neq ROT_n((1+R)X)$$

$$ROT_n(X) \neq ROT_n((1+R+R^2)X) \ldots$$

$$ROT_n(X) \neq ROT_n((1+R+\ldots+R^{n-1})X)=0$$

$$ROT_n((1+R)X) \neq ROT_n((1+R+R^2)X) \ldots$$

$$ROT_n((1+R+\ldots+R^{n-2})X) \neq ROT_n((1+R+\ldots+R^{n-1})X)=0$$

wherein $ROT_n(a)$ is a remainder when dividing a (a is 0 or a positive integer) by n, and X which satisfies $$(1+R+\ldots+R^{n-1})X=n(m+b),$$

wherein b is 0 or a positive integer; and (ii) supplying data assigned to the 1st, 2nd, . . . , the nth display periods to said plurality of signal electrodes respectively in ath, (X+a)th, . . . [(1+R+. . .+$R^{n-2}$)X+a]th selection periods.

2. The driving method of a matrix-type display apparatus as set forth in claim 1, wherein in said step (i), R and n satisfy:

$$pn \neq R,\ R^2,\ R+R^2, \ldots$$

and $$1+R+\ldots+R^{n-1},$$

wherein p is a positive integer; and $$ROT_n(X) = ROT_n(RX) = ROT_n(R^2X) = \ldots$$
$$= ROT_n(R^{n-2}X) = ROT_n(R^{n-1}X) \neq 0.$$

3. The driving method of a matrix-type display apparatus as set forth in claim 1, wherein:

said matrix-type display apparatus includes a ferroelectric liquid crystal as a display medium.

4. The driving method of matrix-type display apparatus as set forth in claim 1, wherein:

said matrix-type display apparatus has g×m scanning electrodes by replacing one scanning electrode by a group of g scanning electrodes (g is an integer of not less than 2), and the group of g scanning electrodes is scanned in one selection period.

5. The driving method of a matrix-type display apparatus as set forth in claim 4, wherein:

in said step (i), R and n satisfy $$pn \neq R,\ R^2,\ R+R^2,$$

and $$1+R+\ldots+R^{n-1},$$

wherein p is a positive integer, and $$ROT_n(X) = ROT_n(RX) = ROT_n(R^2X) = \ldots = ROT_n(R^{n-2}X) = ROT_n(R^{n-1}X) \neq 0.$$

6. The driving method of a matrix-type display apparatus as set forth in claim 4, wherein:

said matrix-type display apparatus includes a ferroelectric liquid crystal as a display medium.

7. A driving method of a matrix-type display apparatus which permits a time-division gradation display, designed for a matrix-type display apparatus having a memory effect which permits a gradation display with a number of gradations R (R is an integer of not less than 2), said matrix-type display apparatus including m scanning electrodes and a plurality of signal electrodes which cross each other, said driving method comprising the steps of:

(i) scanning said m scanning electrodes n times in one frame period under such condition that a time ratio of the 1st, the 2nd, . . . , the nth display periods (n is an integer of not less than 2) is X:RX: . . . :$R^{n-1}$X (X is a positive integer) based on R and n which satisfy $$ROT_n(X+Y) \neq ROT_n((1+R)X+2Y)$$

$$ROT_n(X+Y) \neq ROT_n((1+R+R^2)X+3Y)\ \ldots$$

$$ROT_n(X+Y) \neq ROT_n((1+R+\ldots+R^{n-1})X+(n-1)Y)=0$$

$$ROT_n((1+R)X+2Y) \neq ROT_n((1+R+R^2)X+3Y)\ \ldots$$

$$ROT_n((1+R+\ldots+R^{n-2})X+(n-1)Y) \neq ROT_n((1+R+\ldots+R^{n-1})X)=0$$

wherein $ROT_n(a)$ is a remainder when dividing a (a is 0 or a positive integer) by n, and X+Y is 0 or a positive integer, X and Y which satisfies $$(1+R+\ldots+R^{n-1})X+nY=n(m+b)$$

wherein b is 0 or a positive integer; and (ii) supplying data assigned to the 1st, 2nd, . . . , the nth display periods to said plurality of signal electrodes respectively in ath, (X+Y+a)th, . . . , [(1+R+. . . +$R^{n-2}$)X+(n−1)Y+a]th selection periods.

8. The driving method of a matrix-type display apparatus as set forth in claim 7, wherein:

in said step (i), R and n satisfy $$qn=(R-1)X,$$

wherein q is a positive integer, and $$ROT_n(X+Y) = ROT_n(RX+Y) = ROT_n(R^2X+Y) = \ldots = ROT_n(R^{n-2}X+Y) = ROT_n(R^{n-1}X+Y) \neq 0, \text{ and}$$

X and Y satisfy $$M=n(X+Y),$$

wherein M is a least common multiple of X+Y and n.

9. The driving method of a matrix-type display apparatus as set forth in claim 7, wherein:

said matrix-type display apparatus includes a ferroelectric liquid crystal as a display medium.

10. The driving method of a matrix-type display apparatus as set forth in claim 7, wherein:

said matrix-type display apparatus has g×m scanning electrodes by replacing one scanning electrode by a group of g scanning electrodes (g is an integer of not less than 2), and the group of g scanning electrodes is scanned in one selection period.

11. The driving method of a matrix-type display apparatus as set forth in claim 10, wherein in said step (i), R and n satisfy:

$$qn=(R-1)X,$$

wherein q is a positive integer, and $$ROT_n(X+Y) = ROT_n(RX+Y) = ROT_n(R^2X+Y) = \ldots = ROT_n(R^{n-2}X+Y) = ROT_n(R^{n-1}X+Y) \neq 0, \text{ and}$$

X and Y satisfy $$M=n(X+Y),$$

wherein M is a least common multiple of X+Y and n.

12. The driving method of a matrix-type display apparatus as set forth in claim 10, wherein:

said matrix-type display apparatus includes a ferroelectric liquid crystal as a display medium.

13. A driving method of a matrix-type display apparatus which permits a time-division gradation display, designed for a matrix-type display apparatus having a memory effect which permits a gradation display with a number of gradations R (R is an integer of not less than 2), said matrix-type display apparatus including a plurality of scanning electrodes and a plurality of signal electrodes which cross each other, said driving method comprising the steps of:

(i) scanning said plurality of scanning electrodes n times in one frame period under such condition that a time ratio of the 1st, the 2nd, . . . , the nth display periods (n is an integer of not less than 2) is X:RX: . . . :$R^{n-1}$X (X is a positive integer);

(ii) storing data assigned respectively to the 1st, 2nd, . . . , the nth display periods in a plurality of memory blocks; and (iii) outputting the data from the plurality of memory blocks together for each display period of each scanning electrode, whereby the data is supplied to said plurality of signal electrodes.

14. A matrix-type display apparatus having a memory effect which permits a gradation display with a number of gradations R (R is an integer of not less than 2), said matrix-type display apparatus including m scanning electrodes and a plurality of signal electrodes which cross each other, comprising:

a scanning electrode driving circuit for scanning said m scanning electrodes n times in one frame period under such condition that a time ratio of the 1st, the 2nd, . . . , the nth display periods (n is an integer of not less than 2) is X:RX: . . . :$R^{n-1}$X (X is a positive integer) based on R and n which satisfy $$ROT_n(X) \neq ROT_n((1+R)X)$$

$$ROT_n(X) \neq ROT_n((1+R+R^2)X) \ldots$$

$$ROT_n(X) \neq ROT_n((1+R+\ldots+R^{n-1})X)=0$$

$$ROT_n((1+R)X) \neq ROT_n((1+R+R^2)X) \ldots$$

$$ROT_n((1+R+\ldots+R^{n-2})X) \neq ROT_n((1+R+\ldots+R^{n-1})X)=0$$

wherein $ROT_n(a)$ is a remainder when dividing a (a is 0 or a positive integer) by n, and X which satisfies $(1+R+\ldots+R^{n-1})X=n(m+b)$, wherein b is 0 or positive integer; and a signal electrode driving circuit for supplying data assigned to the 1st, 2nd, . . . , the nth display periods to said plurality of signal electrodes respectively in the ath, (X+a)th, . . . , the $[(1+R+\ldots+R^{n-2})X+a]$th selection periods.

15. The matrix-type display apparatus as set forth in claim 14, comprising:

a plurality of memory blocks which permit addresses to be inputted independently, said plurality of memory blocks storing the data using a common address at a display period of each scanning electrode;

distribution means for distributing the data to said plurality of memory blocks; and control means for storing distributed data using addresses which are different among groups, each group being composed of not less than two blocks and reading the data from each memory block using the common address, whereby the data is outputted to said signal electrode driving circuit.

16. The matrix-type display apparatus a set forth in claim 14, further comprising:

a ferroelectric liquid crystal having a memory effect as a display medium.

17. The matrix-type display apparatus a set forth in claim 14, further comprising:

g×m scanning electrodes by replacing one scanning electrode by a group of g scanning electrodes (g is an integer of not less than 2), wherein said group of g scanning electrodes is scanned in one selection period.

18. The matrix-type display apparatus as set forth in claim 17, comprising:

a plurality of memory blocks which permit addresses to be inputted independently, said plurality of memory blocks storing the data using a common address at a display period of each scanning electrode;

distribution means for distributing the data to said plurality of memory blocks; and control means for storing distributed data using addresses which are different among groups, each group being composed of not less than two memory blocks and reading the data from each memory block using the common address, whereby the data is outputted to said signal electrode driving circuit.

19. The matrix-type display apparatus a set forth in claim 17, further comprising:

a ferroelectric liquid crystal having a memory effect as a display medium.

20. A matrix-type display apparatus having a memory effect which permits a gradation display with a number of gradations R (R is an integer of not less than 2), said matrix-type display apparatus including m scanning electrodes and a plurality of signal electrodes which cross each other, comprising:

a scanning electrode driving circuit for scanning said m scanning electrodes n times in one frame period in such a manner that a time ratio of the 1st, the 2nd, . . . , the nth display periods (n is an integer of not less than 2) is X:RX: . . . :$R^{n-1}$ X (X is a positive integer) based on R and n which satisfy $$ROT_n(X+Y) \neq ROT_n((1+R)X+2Y)$$

$$ROT_n(X+Y) \neq ROT_n((1+R+R^2)X+3Y) \ldots$$

$$ROT_n(X+Y) \neq ROT_n((1+R+\ldots+R^{n-1})X+(n-1)Y)=0$$

$$ROT_n((1+R)X+2Y) \neq ROT_n((1+R+R^2)X+3Y) \ldots$$

$$ROT_n((1+R+\ldots+R^{n-2})X+(n-1)Y) \neq ROT_n((1+R+\ldots+R^{n-1})X)=0$$

wherein $ROT_n(a)$ is a remainder when dividing a (a is 0 or a positive integer) by n, and X and Y which satisfy $$(1+R+\ldots+R^{n-1})X+nY=n(m+b)$$

wherein b is 0 or a positive integer; and a signal electrode driving circuit for supplying data assigned to the 1st, 2nd, . . . , the nth display periods to said plurality of signal electrodes respectively in ath, (X+a)th, . . . , $[(1+R+\ldots+R^{n-2})X+(n-1)Y+a]$th selection periods.

21. The matrix-type display apparatus as set forth in claim 20, comprising:

a plurality of memory blocks which permit addresses to be inputted independently, said plurality of memory blocks storing the data using a common address at a display period of each scanning electrode;

distribution means for distributing the data to said plurality of memory blocks; and control means for storing distributed data using addresses which are different among groups, each group being composed of not less than two memory blocks and reading the data from each memory block using the common address, whereby the data is outputted to said plurality of signal electrode driving circuit.

22. The matrix-type display apparatus a set forth in claim 20, further comprising:

a ferroelectric liquid crystal having a memory effect as a display medium.

23. The matrix-type display apparatus a set forth in claim 20, further comprising:

g×m scanning electrodes by replacing one scanning electrode by a group of g scanning electrodes (g is an integer of not less than 2), wherein the group of g scanning electrodes is scanned in one selection period.

24. The matrix-type display apparatus as set forth in claim 23, comprising:

a plurality of memory blocks which permit addresses to be inputted independently, said plurality of memory blocks storing the data using a common address at a display period of each scanning electrode;

distribution means for distributing the data to said memory blocks; and control means for storing distributed data using addresses which are different among groups, each group being composed of not less than two memory blocks and reading the data from each memory block using the common address, whereby the data is outputted to said plurality of signal electrode driving circuit.

25. The matrix-type display apparatus a set forth in claim 23, further comprising:

a ferroelectric liquid crystal having a memory effect as a display medium.

26. A matrix-type display apparatus having a memory effect which permits a gradation display with a number of gradations R (R is an integer of not less than 2), said matrix-type display apparatus including a plurality of scanning electrodes and a plurality of signal electrodes which cross each other, comprising:

a scanning electrode driving circuit for scanning said plurality of scanning electrodes n times in one frame period in such a manner that a time ratio of the 1st, the 2nd, . . . the nth display periods (n is an integer of not less than 2) is X:RX: . . . :$R^{n-1}$X (X is a positive integer);

a signal electrode driving circuit for supplying data assigned to each display period to the signal electrode respectively in selection periods of said plurality of scanning electrodes;

a plurality of memory blocks which permit addresses to be inputted independently, said plurality of memory blocks storing the data using a common address at a display period of each scanning electrode;

distribution means for distributing the data to said plurality of memory blocks; and control means for storing distributed data using addresses which are different among groups, each group being composed of not less than two memory blocks and reading the data from each memory block using the common address, whereby the data is outputted to said plurality of signal electrode driving circuit.

* * * * *